United States Patent [19]

Elko et al.

[11] Patent Number: 4,741,038

[45] Date of Patent: Apr. 26, 1988

[54] SOUND LOCATION ARRANGEMENT

[75] Inventors: Gary W. Elko, Summit; James L. Flanagan; James D. Johnston, both of Warren, all of N.J.

[73] Assignee: American Telephone and Telegraph Company, AT&T Bell Laboratories, Murray Hill, N.J.

[21] Appl. No.: 911,989

[22] Filed: Sep. 26, 1986

[51] Int. Cl.[4] ..... H04R 3/00

[52] U.S. Cl. ..... 381/92; 367/121

[58] Field of Search ..... 367/121, 125, 123; 381/66, 92

[56] References Cited

U.S. PATENT DOCUMENTS

| | | | |
|---|---|---|---|
| 4,066,842 | 1/1978 | Allen . | |
| 4,131,760 | 12/1978 | Christensen et al. . | |
| 4,333,170 | 6/1982 | Mathews et al. | 367/125 |
| 4,480,322 | 10/1984 | Orieux et al. | 367/125 |
| 4,485,484 | 11/1984 | Flanagan . | |

*Primary Examiner*—Forester W. Isen

*Attorney, Agent, or Firm*—Jack S. Cubert; Wilford L. Wisner

[57] ABSTRACT

A signal processing arrangement is connected to a microphone array to form at least one directable beam sound receiver. The directable beam sound receivers are adapted to receive sounds from predetermined locations in a prescribed environment such as auditorium. Signals representative of prescribed sound features received from the plurality of predetermined locations are generated and one or more of the locations is selected responsive to the sound feature signals. A plurality of directable beam sound receivers may be used to concurrently analyze sound features from the predetermined locations. Alternatively, one directable beam sound receiver may be used to scan the predetermined locations so that the sound feature signals therefrom are compared to sound features from a currently selected location.

14 Claims, 15 Drawing Sheets

CHANNEL CIRCUIT

BEAM POSITIONING

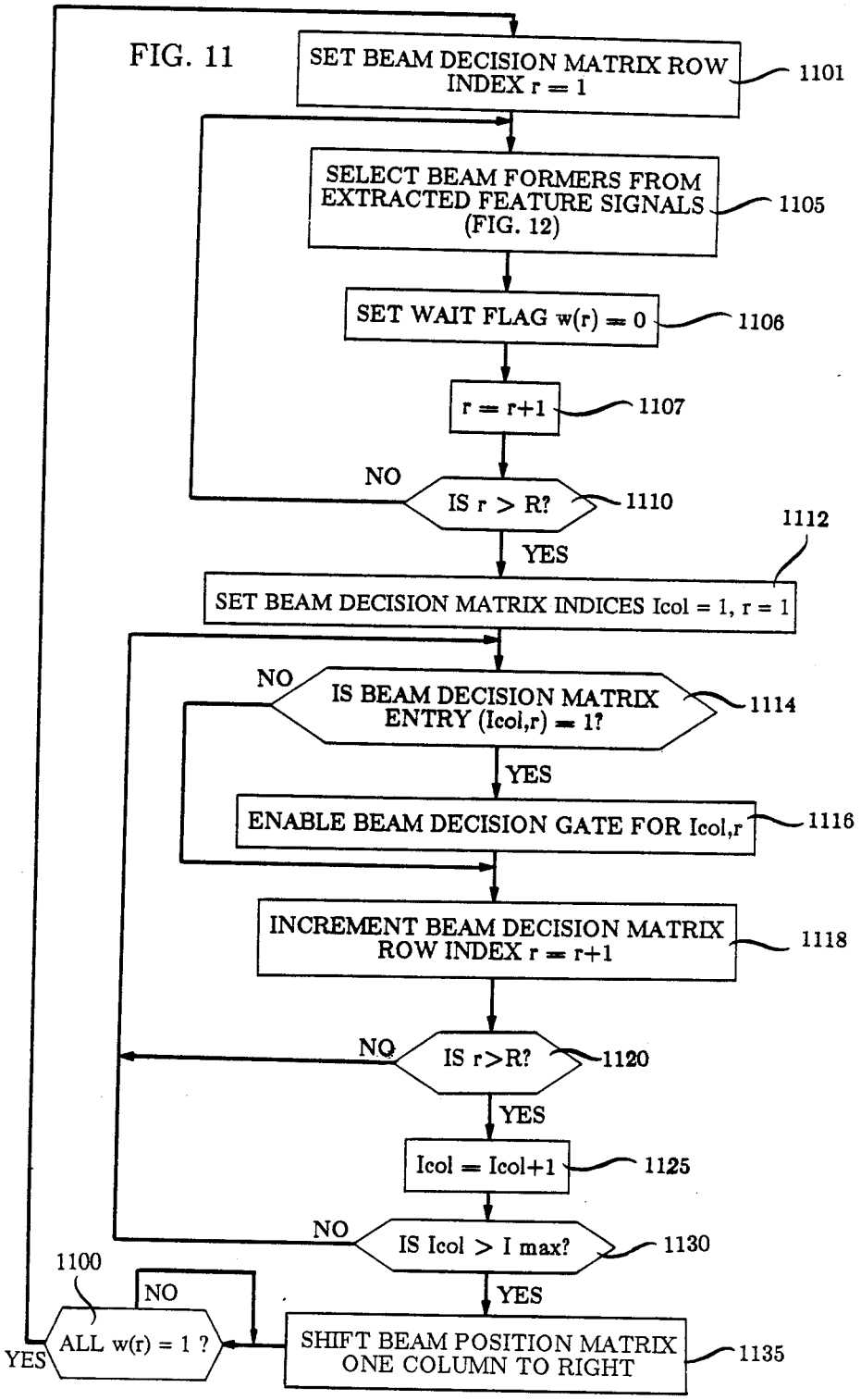
FIG. 11
SET BEAM DECISION MATRIX ROW INDEX r = 1
1101
SELECT BEAM FORMERS FROM EXTRACTED FEATURE SIGNALS (FIG. 12)
1105
SET WAIT FLAG w(r) = 0
1106
r = r+1
1107
NO
IS r > R?
1110
YES
1112
SET BEAM DECISION MATRIX INDICES Icol = 1, r = 1
NO
IS BEAM DECISION MATRIX ENTRY (Icol,r) = 1?
1114
YES
ENABLE BEAM DECISION GATE FOR Icol,r
1116
INCREMENT BEAM DECISION MATRIX ROW INDEX r = r+1
1118
NO
IS r>R?
1120
YES
Icol = Icol+1
1125
NO
IS Icol > I max?
1130
YES
1100
NO
ALL w(r) = 1 ?
YES
SHIFT BEAM POSITION MATRIX ONE COLUMN TO RIGHT
1135

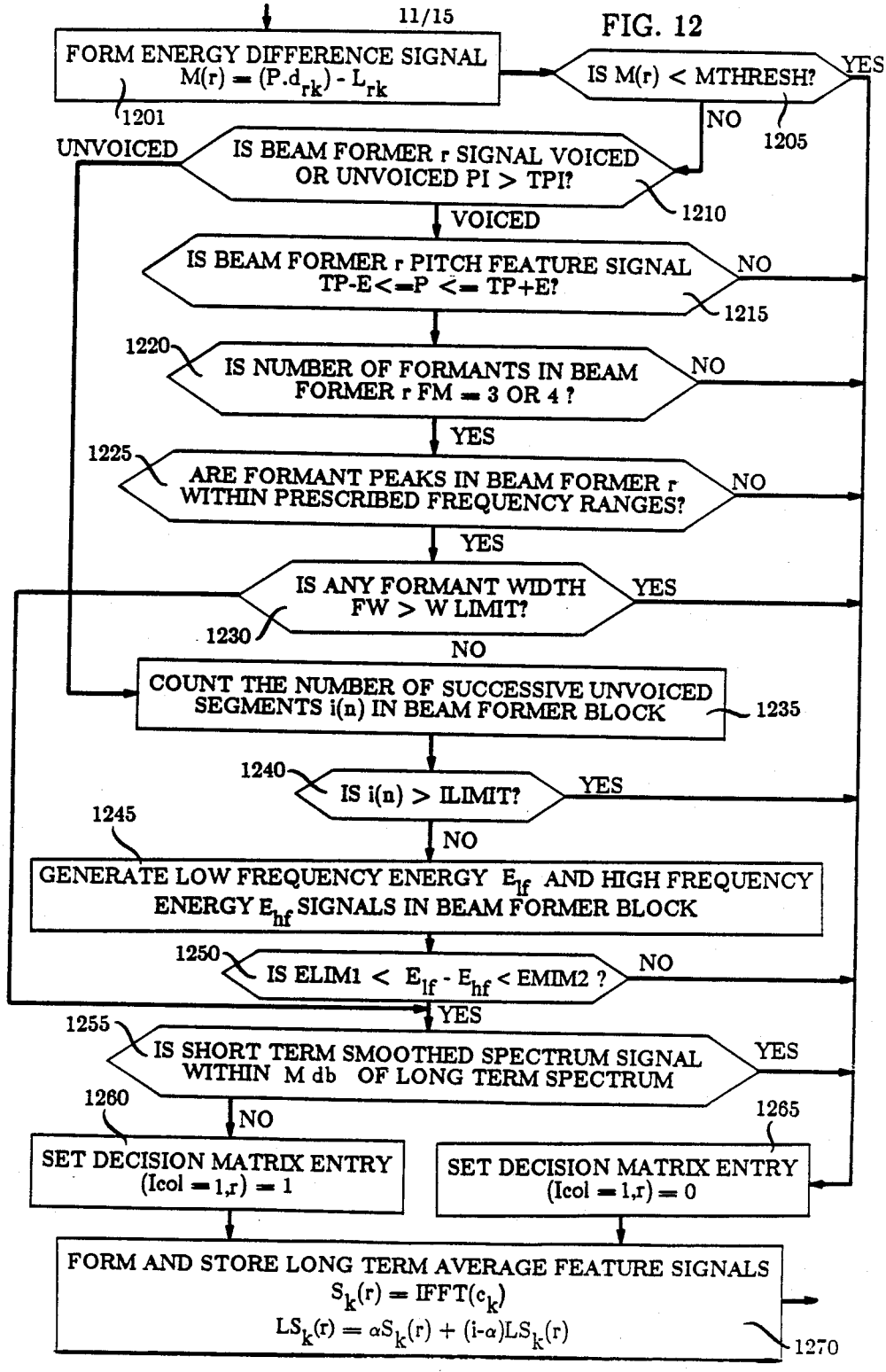
11/15
FIG. 12
FORM ENERGY DIFFERENCE SIGNAL
M(r) = (P.d_rk) - L_rk
1201
IS M(r) < MTHRESH?
YES
NO
1205
UNVOICED
IS BEAM FORMER r SIGNAL VOICED OR UNVOICED PI > TPI?
1210
VOICED
IS BEAM FORMER r PITCH FEATURE SIGNAL TP-E<=P <= TP+E?
NO
1215
1220
IS NUMBER OF FORMANTS IN BEAM FORMER r FM = 3 OR 4 ?
NO
YES
1225
ARE FORMANT PEAKS IN BEAM FORMER r WITHIN PRESCRIBED FREQUENCY RANGES?
NO
YES
IS ANY FORMANT WIDTH FW > W LIMIT?
YES
1230
NO
COUNT THE NUMBER OF SUCCESSIVE UNVOICED SEGMENTS i(n) IN BEAM FORMER BLOCK
1235
1240
IS i(n) > ILIMIT?
YES
1245
NO
GENERATE LOW FREQUENCY ENERGY E_lf AND HIGH FREQUENCY ENERGY E_hf SIGNALS IN BEAM FORMER BLOCK
1250
IS ELIM1 < E_lf - E_hf < EMIM2 ?
NO
YES
1255
IS SHORT TERM SMOOTHED SPECTRUM SIGNAL WITHIN M db OF LONG TERM SPECTRUM
YES
1260
NO
1265
SET DECISION MATRIX ENTRY (Icol = 1,r) = 1
SET DECISION MATRIX ENTRY (Icol = 1,r) = 0
FORM AND STORE LONG TERM AVERAGE FEATURE SIGNALS
S_k(r) = IFFT(c_k)
LS_k(r) = αS_k(r) + (i-α)LS_k(r)
1270

SOUND LOCATION ARRANGEMENT

TECHNICAL FIELD

The invention relates to acoustic signal processing and more particularly to arrangements for determining sources of sound.

BACKGROUND OF THE INVENTION

It is well known in the art that a sound produced within a reflective environment may traverse many diverse paths in reaching a receiving transducer. In addition to the direct path sound, delayed reflections from surrounding surfaces, as well as extraneous sounds, reach the transducer. The combination of direct, reflected and extraneous signals result in the degradation of the audio system quality. These effects are particularly noticeable in environments such as classrooms, conference rooms or auditoriums. To maintain good quality, it is a common practice to use microphones in close proximity to the sound source or to use directional microphones. These practices enhance the direct path acoustic signal with respect to noise and reverberation signals.

There are many situations, however, in which the location of the source with respect to the electroacoustic transducer is difficult to control. In conferences involving many people, for example, it is difficult to provide each individual with a separate microphone or to devise a control system for individual microphones. One technique disclosed in U.S. Pat. No. 4,066,842 issued to J. B. Allen, Jan. 3, 1978, utilizes an arrangement for reducing the effects room reverberation and noise pickup in which signals from a pair of omnidirectional microphones are manipulated to develop a single, less reverberant signal. This is accomplished by partitioning each microphone signal into preselected frequency components, cophasing corresponding frequency components, adding the cophased frequency components signals, and attenuating those cophased frequency component signals that are poorly correlated between the microphones.

Another technique disclosed in U.S. Pat. No. 4,131,760 issued to C. Coker et al, Dec. 26, 1978, is operative to determine the phase difference between the direct path signals of two microphones and to phase align the two microphone signals to form a dereverberated signal. The foregoing solutions to the noise and dereverberation problems work as long as the individual sound sources are well separated, but they do not provide appropriate selectivity. Where it is necessary to conference a large number of individuals, e.g., the audience in an auditorium, the foregoing methods do not adequately reduce noise and reverberation since these techniques do not exclude sounds from all but the location of desired sources.

U.S. Pat. No. 4,485,484 issued to J. L. Flanagan on Nov. 27, 1984 and assigned to the same assignee discloses a microphone array arrangement in which signals from a plurality of spaced microphones are processed so that a plurality of well defined beams are directed to a predetermined location. The beams discriminate against sounds from outside a prescribed volume. In this way, noise and reverberation that interfere with sound pickup from the desired source are substantially reduced.

While the signal processing system of U.S. Pat. No. 4,485,484 provides improved sound pickup, the microphone array beams must first be steered to one or more appropriate sources of sound for it to be effective. It is further necessary to be able to redirect the microphone array beam to other sound sources quickly and economically. The arrangement of aforementioned U.S. Pat. No. 4,131,760 may locate a single sound source in a noise free environment but is not adapted to select one sound source where there is noise or several concurrent sound sources. It is an object of the invention to provide an improved sound source detection capable of automatically focusing microphone arrays at one or more selected sound locations.

BRIEF SUMMARY OF THE INVENTION

The invention is directed to a signal processing arrangement that includes at least one directable beam sound receiver adapted to receive sounds from predetermined locations. Signals representative of prescribed sound features received from the predetermined locations are generated and one or more of said locations are selected responsive to said sound feature signals.

According to one aspect of the invention, each of a plurality of directable sound receiving beams receives sound waves from a predetermined location. The sound feature signals from the plurality of beams are analyzed to select one or more preferred sound source locations.

According to another aspect of the invention, a directable sound receiving beam sequentially scans the predetermined locations, and the sound feature signals from the locations are compared to select one or more preferred sound sources.

According to yet another aspect of the invention, at least one directable sound receiving beam is pointed at a reference location and another directable beam scans the predetermined locations. Prescribed sound feature signals from the scanning beam and the reference beam are compared to select one or more of the predetermined locations.

BRIEF DESCRIPTION OF THE DRAWING

FIGS. 9–12 show flow charts illustrating the operation of the circuit of FIG. 1 in selecting sound pickup locations;

DETAILED DESCRIPTION

Figure 1:
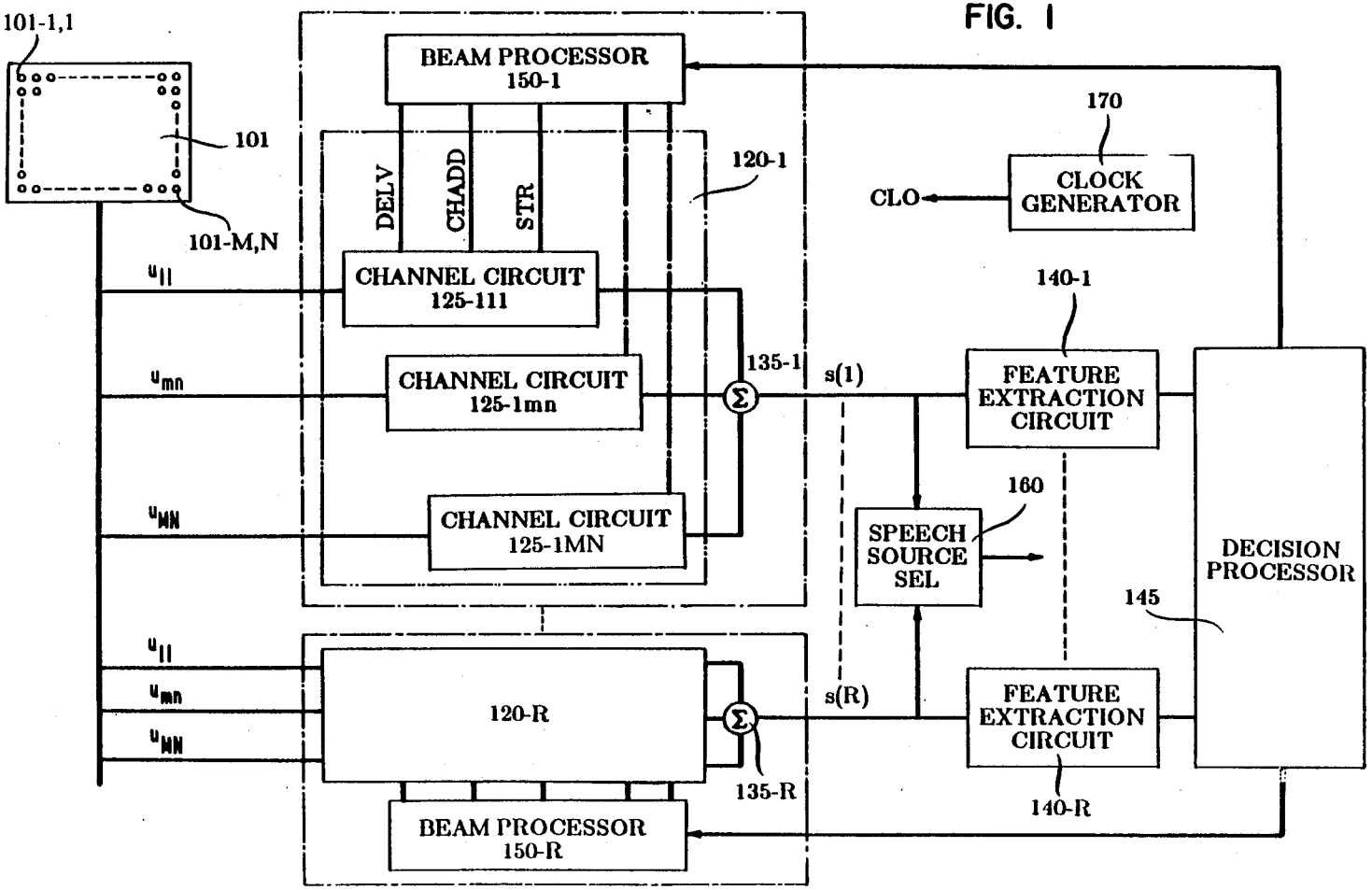
FIG. 1 depicts a general block diagram of one embodiment of an audio signal processing illustrative of the invention.

FIG. 1 shows a directable beam microphone array signal processing arrangement adapted to produce one or more independent directional sound receiving beams in an environment such as a conference room or an auditorium. The sound signal picked up by each beam is analyzed in a signal processor to form one or more acoustic feature signals. An analysis of the feature signals from the different beam directions determines the location of one or more desired sound sources so that a directable beam may be focused thereat. The circuit of FIG. 1 includes microphone array 101, beamformer circuits 120-1 through 120-R, beamformer summers 135-1 through 135-R, acoustic feature extraction circuits 140-1 through 140-R, decision processor 145, beam directing processors 150-1 through 150-R and source selector circuit 160.

Microphone array 101 is, in general, an m by n rectangular structure that produces a signal $u_{mn}(t)$ from each transducer but may also be a line array of transducers. The transducer signals $u_{11}(t)$, $u_{12}(t)$, . . . $u_{mn}(t)$, . . . $u_{MN}(t)$ are applied to each beamformers 120-1 through 120-R. For example, transducer signals $u_{11}$ through $u_{MN}$ are supplied to channel circuits 125-111 through 125-1MN of beamformer 120-1. The channel circuits are operative to modify the transducer signals applied thereto so that the directional response pattern obtained from summer 135-1 is in the form of a narrow cigar-shaped beam pointed in a direction defined by beam processor circuit 150-1. Similarly, the transducer signals $u_{11}(t)$ through $u_{MN}(t)$ are applied to beamformer 120-R whose channel circuits are controlled by beam processor 150-R to form an independently directed beam.

As is readily seen from FIG. 1, R independently directed beam sound receivers are produced by beamformers 120-1 through 120-R. The sound signals from the beamformers are applied to source selector circuit 160 via summers 135-1 through 135-R. The source selector circuit comprises a plurality of gating circuits well known in the art and is operative to gate selected beam signals whereby the sound signals from one or more selected beams are passed therethrough. Beam selection is performed by generating sound signal features in each of the feature extraction circuits 140-1 through 140-R and comparing the extracted feature signals to feature thresholds in decision processor 145. The feature signals may comprise signals distinguishing speech from noise or reverberations such as the short term average energy and the long term average energy of the beam sound signals, the zero crossing count of the beam sound signals, or signals related to formant structure or other speech features. Decision processor 145 generates control signals which are applied to source selector 160 to determine which beamformer summer outputs are gated therethrough. The decision processor also provides signals to beam processor circuits 150-1 through 150-R to direct beam formation.

Figure 7:
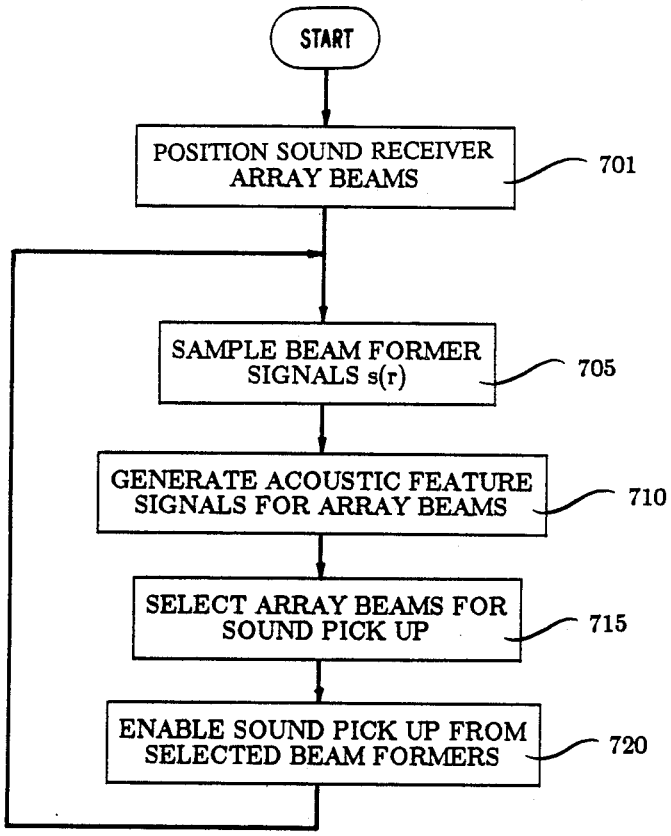
FIG. 7 shows a flow chart illustrating the general operation of embodiments of the invention.

The flow chart of FIG. 7 illustrates the general operation of the arrangement of FIG. 1 in which a plurality of sound receiver beams are fixedly pointed at prescribed locations in the conference environment. Referring to FIG. 7, sound receiver beams are produced and positioned by beamformer circuits 120-1 through 120-R as per step 701. The sound signals received from the beams are then sampled (step 705) and acoustic feature signals are formed for each beam (step 710). The beam feature signals are analyzed and one or more beams are selected for sound pickup (step 715). The selected beam outputs from beamformer summer circuits 135-1 through 135-R of FIG. 1 are then gated to the output of source selector 160 (step 720). The loop including steps 705, 710, 715 and 720 is then periodically iterated by reentering step 705 so that beam selection may be updatd to adapt sound source selection to changing conditions in the environment.

Figure 5:
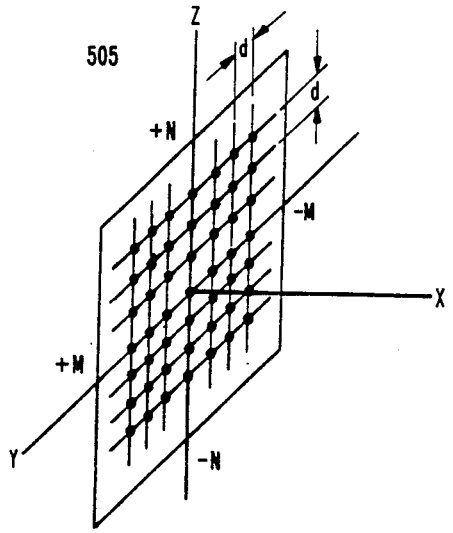
FIGS. 5 and 6 illustrate a transducer arrangement useful in embodiments of the invention.

Transducer array 101 of FIG. 1 comprises a rectangular arrangement of regularly spaced electroacoustic transducers. The transducer spacing is selected, as is well known in the art, to form a prescribed beam pattern normal to the array surface. It is to be understood that other array arrangements known in the art including line arrays may also be used. In a classroom environment, array 101 may be placed on one wall or on the ceiling so that the array beam patterns can be dynamically steered to all speaker locations in the interior of the room. The transducer array may comprise a set of equispaced transducer elements with one element at the center and an odd number of elements in each row M and column N as shown in FIG. 5. It is to be understood, however, that other transducer arrangements using non-uniformly spaced transducers may also be used. The elements in the array of FIG. 5 are spaced a distance d apart so that the coordinates of each element are $$y=md,\ -M\leqq m\leqq M$$

$$z=nd,\ -N\leqq n\leqq N \tag{1}$$

The configuration is illustrated in FIG. 5 in which the array is located in the y,z plane.

The outputs of the individual transducer elements in each array produce the frequency response $$H(\omega,\theta,\phi) = \sum_m \sum_n P(m,n) = \sum_m \sum_n A(m,n)\, e^{-j\omega\tau(m,n)} \tag{2}$$

where $\theta$ is the azimuthal angle measured from the x axis and $\phi$ is the polar angle measured from the z axis. $\theta$ and $\phi$ define the direction of the sound source. P is the sound pressure at element (m,n), A(m,n) is the wave amplitude and $\tau$(m,n) is the relative delay at the m,nth transducer element. Both A(m,n) and $\tau$(m,n) depend upon the direction $(\iota,\phi)$. $H(\iota,\theta,\phi)$ is, therefore, a complex quantity that describes the array response as a function of direction for a given radian frequency $\omega$. For a particular direction $(\theta,\phi)$, the frequency response of the array is $$H(\omega) = \sum_m \sum_n A(m,n)\, e^{-j\omega\tau(m,n)} \tag{3}$$

and the corresponding time response to an impulsive source of sound is $$h(t) = \sum_m \sum_n A(m,n)\delta(t - \tau(m,n)) \tag{4}$$

where $\delta(t)$ is the unit impulse function.

An impulsive plane wave arriving from a direction perpendicular to the array ($\theta=0$, $\phi=\pi/2$), results in the response $$h(t)_{0,\pi/2}=(2M+1)(2N+1)\delta(t). \tag{5}$$

If the sound is received from any other direction, the time response is a string of (2M+1)(2N+1) impulses occupying a time span corresponding to the wave transit time across the array.

Figure 6:
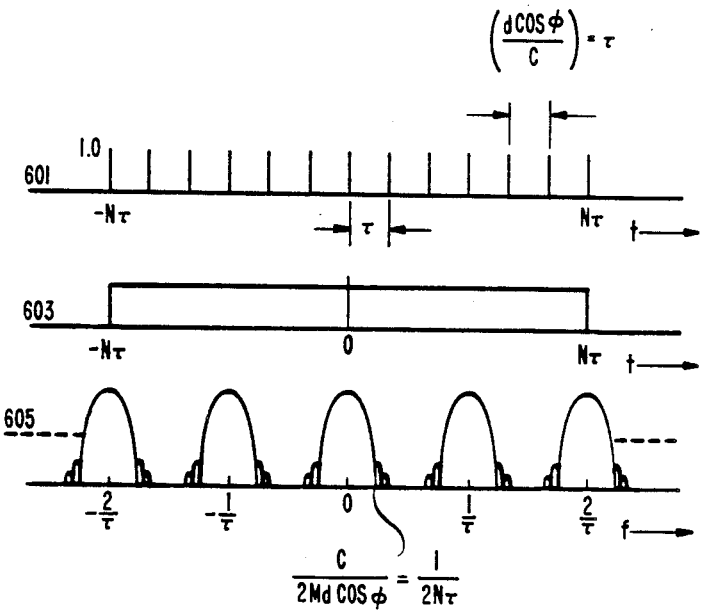

In the simple case of a line array of 2N+1 receiving transducers oriented along the z axis (y=0) in FIG. 6. e.g., line 505, the response as a function of $\phi$ and $\omega$ is $$H(\omega,\phi) = \sum_n A_n e^{\frac{(j\omega nd\cos\phi)}{c}}, \quad -N \leqq n \leqq N \tag{6}$$

where c is the velocity of sound. $A_n=1$ for a plane wave so that the time response is $$h(t) = \sum_n A_n \delta[t - \tau(n)] \tag{7}$$

where $$\tau_n = \frac{nd\cos\phi}{c}, \quad -N \leqq n \leqq N.$$

As shown in equation 7, the response is a string of impulses equispaced at d cos $\phi$/c and having a duration of 2Nd cos 100 /c. Alternatively, the response may be approximately described as $$h(t) = e(t) \sum_{n=-\infty}^{\infty} \delta[t - \tau(n)] \tag{8}$$

where e(t) is a rectangular envelope and $$e(t) = 1 \text{ for } -N\frac{d\cos\phi}{c} \leqq t \leqq \frac{Nd\cos\phi}{c} \text{ and 0, otherwise.} \tag{9}$$

The impulse train is shown in waveform 601 of FIG. 6 and the e(t) window signal is shown in waveform 603.

The Fourier transform of h(t) is the convolution $$F[h(t)] = H(\omega) = F[e(t)]*F\left[\sum_n \delta\left(t + \frac{nd\cos\phi}{c}\right)\right] \tag{10}$$

where $$F[e(t)] = E(\omega) = \frac{\sin\frac{\omega Nd\cos\phi}{c}}{\frac{\omega Nd\cos\phi}{c}}.$$

The Fourier transform of the e(t)(waveform 603) convolved with the finite impulse string (waveform 601) is an infinite string of (sin x/x) functions in the frequency domain spaced along the frequency axis at a sampling frequency increment of (c/d cos $\phi$) Hz as illustrated in waveform 605 FIG. 6.

The low bound on the highest frequency for which the array can provide directional discrimination is set by the end-on arrival condition ($\phi$=0) and is c/d Hz. Signal frequencies higher than c/d Hz lead to aliasing in the array output. The lowest frequency for which the array provides spatial discrimination is governed by the first zero of the sin x/x term of equation 10 which in this approximation is c/2Nd Hz. Consequently, the useful bandwidth of the array is approximated by $$\frac{1}{2N}\left[\frac{c}{d}\right] \leqq f \leqq \frac{2N-1}{2N}\,\frac{c}{d}. \tag{11}$$

In general, therefore, the element spacing is determinative of the highest frequency for which the array provides spatial discrimination, and the overall dimension (2Nd) determines the lowest frequency at which there is spatial discrimination.

The foregoing is applicable to a two-dimension rectangular array which can be arranged to provide two dimension spatial discrimination, i.e., a cigar-shaped beam, over the frequency range between 300 and 8000 Hz. For example, an 8 kHz upper frequency limit for a fixed array is obtainable with a transducer element spacing of d=(8000/c)=4.25 cm. A 300 Hz low frequency limit results from a 27 by 27 element array at spacing d=4.25 cm. The overall linear dimension of such an array is 110.5 cm. In similar fashion, circular or other arrays of comparable dimensions may also be designed with or without regular spacing. The described arrangements assume a rectangular window function. Window tapering techniques, well known in the art, may also be used to reduce sidelobe response. The rectangular window is obtained by having the same sensitivity at all transducer elements. The 27 by 27 rectangular array is given by way of example. It is to be understood that other configurations may also be utilized. A larger array produces a narrower beam pattern, while a smaller array results in a broader beam pattern.

Every beamformer circuit, e.g., 120-1 in FIG. 1, comprises a set of microphone channel circuits 120-111 through 120-1MN. Each transducer of array 101 in FIG. 1 is connected to a designated microphone channel circuit. Upper left corner transducer 101-11 is, for example, connected to channel circuit 120-r11 of every beamformer 1≦r≦R. Upper right corner transducer 101-1N is connected to channel circuit 120-r1N and lower right corner transducer 101-rMN is connected to channel circuit 120-rMN. Each channel circuit is adapted to modify the transducer signal applied thereto in response to signals from its associated beam processor.

The spatial response of planar array 101 has the general form $$H(\theta,\phi) = \sum_m \sum_n P e^{-j\omega\tau(m,n)}. \tag{12}$$

$\tau$(m,n) is a delay factor that represents the relative time of arrival of the wavefront at the m,nth transducer element in the array. Beamformer circuits 120-1 through 120-R are operative to insert delay $-\tau$(m,n) and possibly amplitude modifications in each transducer element (m,n) output so that the array output is cophased with an appropriate window function for any specified $\theta,\phi$ direction. A fixed delay $\tau_o$ in excess of the wave transit time across one-half the longest dimension of the array is added to make the system casual. The spatial response of the steerable beam is then $$H(\theta,\phi) = \sum_m \sum_n P e^{-j\omega[\tau(m,n)]}\, e^{-j\omega[\tau 0 - \tau'(m,n)]}. \tag{13}$$

In a rectangular array, the steering term is $$\tau'(m,n) = -\frac{d}{c}(m\sin\phi\sin\theta + n\cos\phi) \quad (14)$$

with $$\tau_o \geqq (M^2+N^2)^{\frac{1}{2}}d/c. \quad (15)$$

The beam pattern of the array can then be controlled by supplying a $\tau'(m,n)$ delay signal to each transducer element. These delay signals may be selected to point the array beam in any desired direction $(\theta,\phi)$ in three spatial dimensions.

Figure 2:
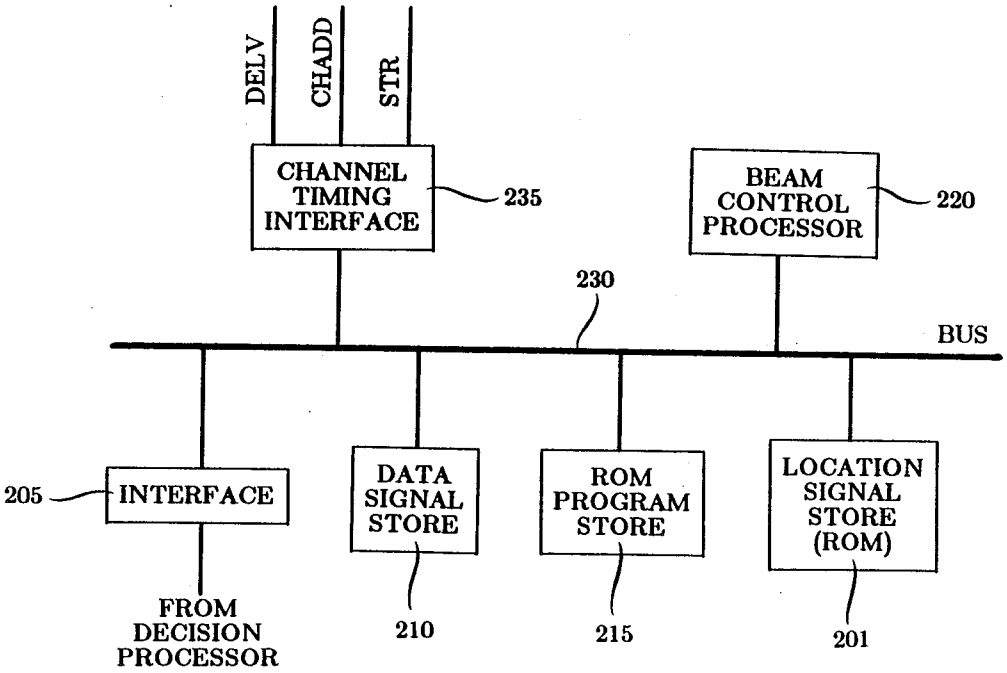
FIG. 2 shows a block diagram of a beam processing circuit useful in embodiments of the invention.

Each of the r beam processor circuits, e.g. 150-1 for beamformer 120-1, includes stored beam location signals that direct the beamformer directional pattern to a particular location in the conference environment. The location signals correspond to prescribed directions $(\theta,\phi)$ in equation 14. Processor 150-1 generates channel circuit delay signals responsive to the stored beam location signals. The beam processor circuit 150-1 shown in greater detail in FIG. 2 comprises location signal read-only memory (ROM) 201, program signal memory 215, data signal store 210, beam control processor 220, signal bus 230 and channel circuit interface 235. ROM 201 contains a permanently stored table of delay codes arranged according to location in the conference environment. For each location L, there is a set of 2MN addressable codes corresponding to the transducer elements of array 101. When a prescribed location L in ROM 201 is addressed, delay codes are made available for each transducer channel circuit of the beamformer 120-1 associated with beam processor 150-1. While a separate location signal store for each beam processor is shown in FIG. 2, it is to be understood that a single location signal store may be used for all beam processors using techniques well known in the art.

Signal processor 220 may comprise a microprocessor circuit arrangement such as the Motorola 68000 described in the publication MC68000 16 Bit Microprocessor User's Manual, Second Edition, Motorola, Inc., 1980, and associated memory and interface circuits. The operation of the signal processor is controlled by permanently stored instruction codes contained in instruction signal read-only memory 215. The processor sequentially addresses the transducer element channel circuit codes of the currently addressed location in ROM 201. Each channel circuit address signal is applied to the channel address input of ROM 201. The delays DELV corresponding to the current channel address are retrieved from ROM 201 and are supplied to the channel circuits of beamformer 120-1 via channel interface 235. The delay signals are applied to all the channel circuits of channel processor 120-1 in parallel. The circuit channel address is supplied to all channel circuits so that one channel circuit is addressed at a time.

Figure 8:
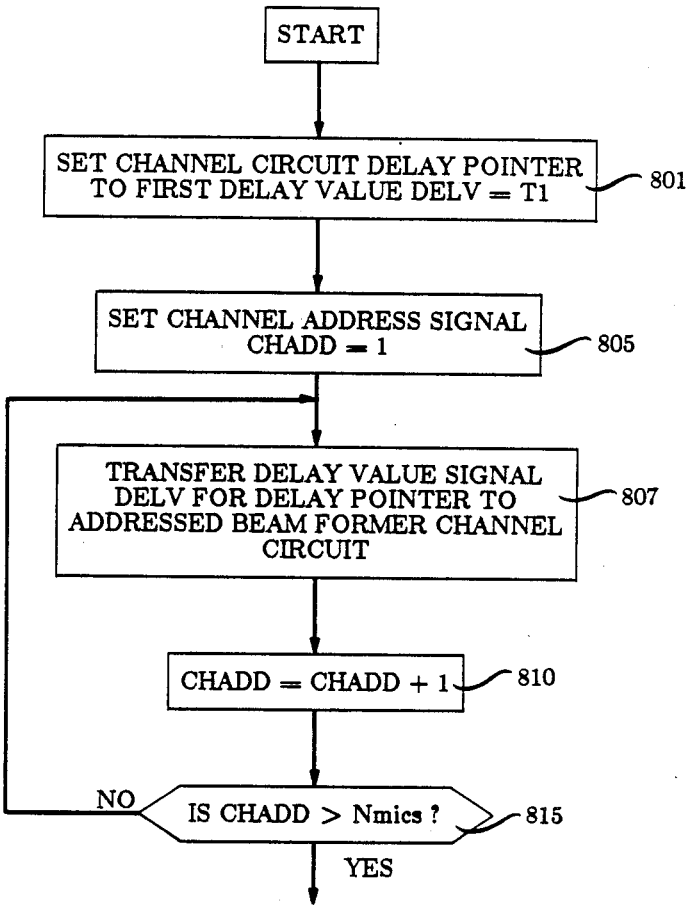
FIG. 8 shows a flow chart illustrating the operation of the beam processing circuit of FIG. 2 and the channel circuit of FIG. 3 in directing beam formation.

The operation of the processor in directing its beamformer is illustrated in the flow chart of FIG. 8. Referring to FIG. 8, the delay address signal in the beam processor is set to its first value in step 801 and the channel address signal CHADD is set to the first channel circuit in step 805 when the processor of FIG. 1 is enabled to position the beam of the associated beamformer. The current selected transducer (CHADD) is addressed and the delay signal DELV for the selected transducer is transferred from store 201 to channel circuit CHADD (step 807). The channel address signal is incremented in step 810 and compared to the last column index Nmics in step 815. Until CHADD is greater than Nmics, step 807 is reentered. When CHADD exceeds Nmics, the last channel circuit of the beamformer had received the required delay signal. The sequence of instruction code signals adapted to control a beam processor to perform the operations of FIG. 8 is set forth in C language in Appendix A hereto.

Figure 3:
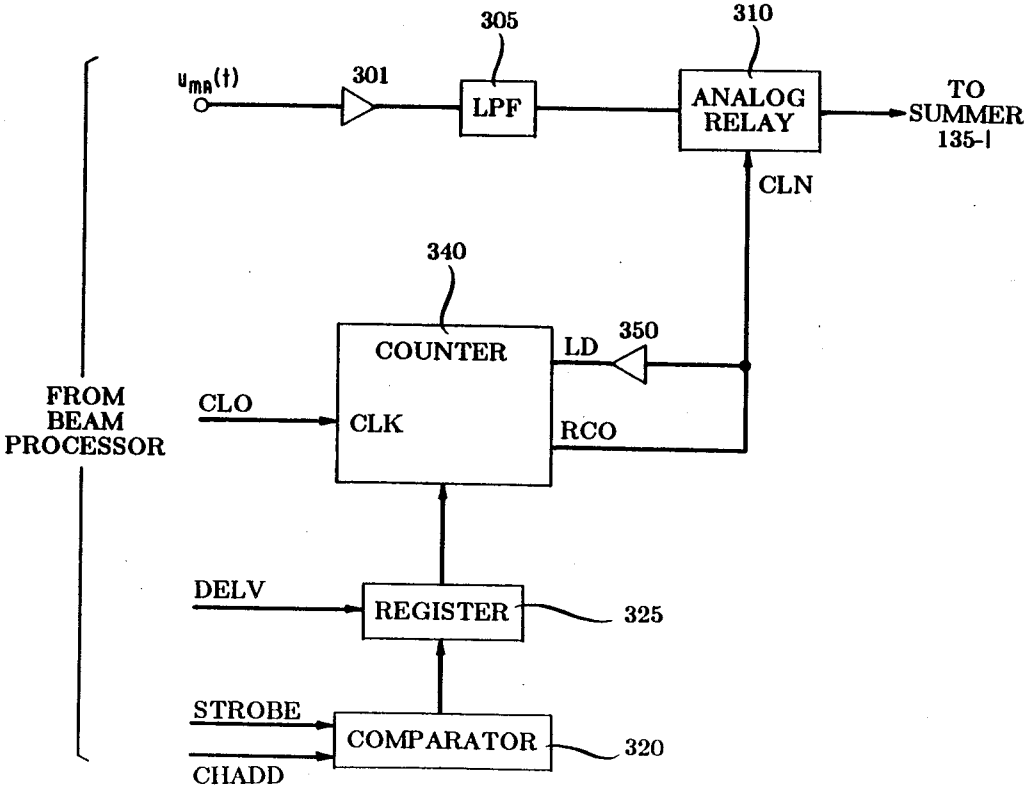
FIG. 3 shows a detailed block diagram of a beamformer channel circuit useful in embodiments of the invention.

FIG. 3 shows a detailed block diagram of the channel circuit used in beamformers channel 120-1 through 120-R, e.g., 120-1. As indicated in FIG. 3, the output of a predetermined transducer, e.g., $u_{m,n}(t)$, is applied to the input amplifier 301. The amplified transducer signal is filtered in low pass filter 305 to eliminate higher frequency components that could cause aliasing. After filtering, the transducer signal is supplied to analog delay 310 which retards the signal responsive to the channel delay control signal from the controlling beam processor 150-1. The delays in the channel circuits transform the transducer outputs of array 101 into a controlled beam pattern signal.

The analog delay in FIG. 3 may comprise a bucket brigade device such as the Reticon type R-5106 analog delay line. As is well known in the art, the delay through the Reticon type device is controlled by the clock rate of clock signals applied thereto. In FIG. 3, the current delay control signal DELV from processor 150-1 is applied to register circuit 325. The current channel address signal CHADD is applied to the input of comparator 320. When the address signal CHADD matches the locally stored channel circuit address, comparator circuit 320 is enabled, and the delay control signal DELV from the microprocessor of beam processor circuit 150-1 is inserted into register 325.

Counter 340 comprises a binary counter circuit operative to count constant rate clock pulses CLO from clock generator 170. Upon attaining its maximum state, counter 340 provides a pulse on its RCO output which pulse is applied to the clock input CLN of analog delay 310. This pulse is also supplied to the counter load input via inverter circuit 350 so that the delay control signal stored in register 325 is inserted into counter 340. The counter then provides another count signal after a delay corresponding to the difference between the delay control signal value and the maximum state of the counter.

The pulse output rate from counter 340 which controls the delay of the filtered transducer signal in analog delay 310 is then an inverse function of the delay control signal from beam processor 150-1. An arrangement adapted to provide a suitable delay range for the transducer arrays described herein can be constructed utilizing, for example, a seven stage counter and an oscillator having a CLO clock rate of 12.8 MHz. With a 256 stage bucket brigade device of the Reticon type, the delay is $$d = \frac{2(128-n)256}{12.8\ \text{MHz}} \quad (16)$$

where n may have values between 1 and 119. The resulting delay range is between 0.36 ms and 5.08 ms with a resolution of 0.04 ms.

Beamformer circuit 120-1 is effective to "spatially" filter the signals from the transducer elements of array 101. Consequently, the summed signal obtained from adder 135-1 is representative of the sounds in the beam pattern defined by the coded delay in ROM 201 for its predetermined location. In similar fashion, the other beamformers filter the acoustic signal picked up by transducer elements of array 101, and the signal from each of summing circuits 135-1 through 135-R corresponds to the sounds in the beam pattern defined by the coded signals in ROM 201 of the corresponding beam processor.

Figure 9:
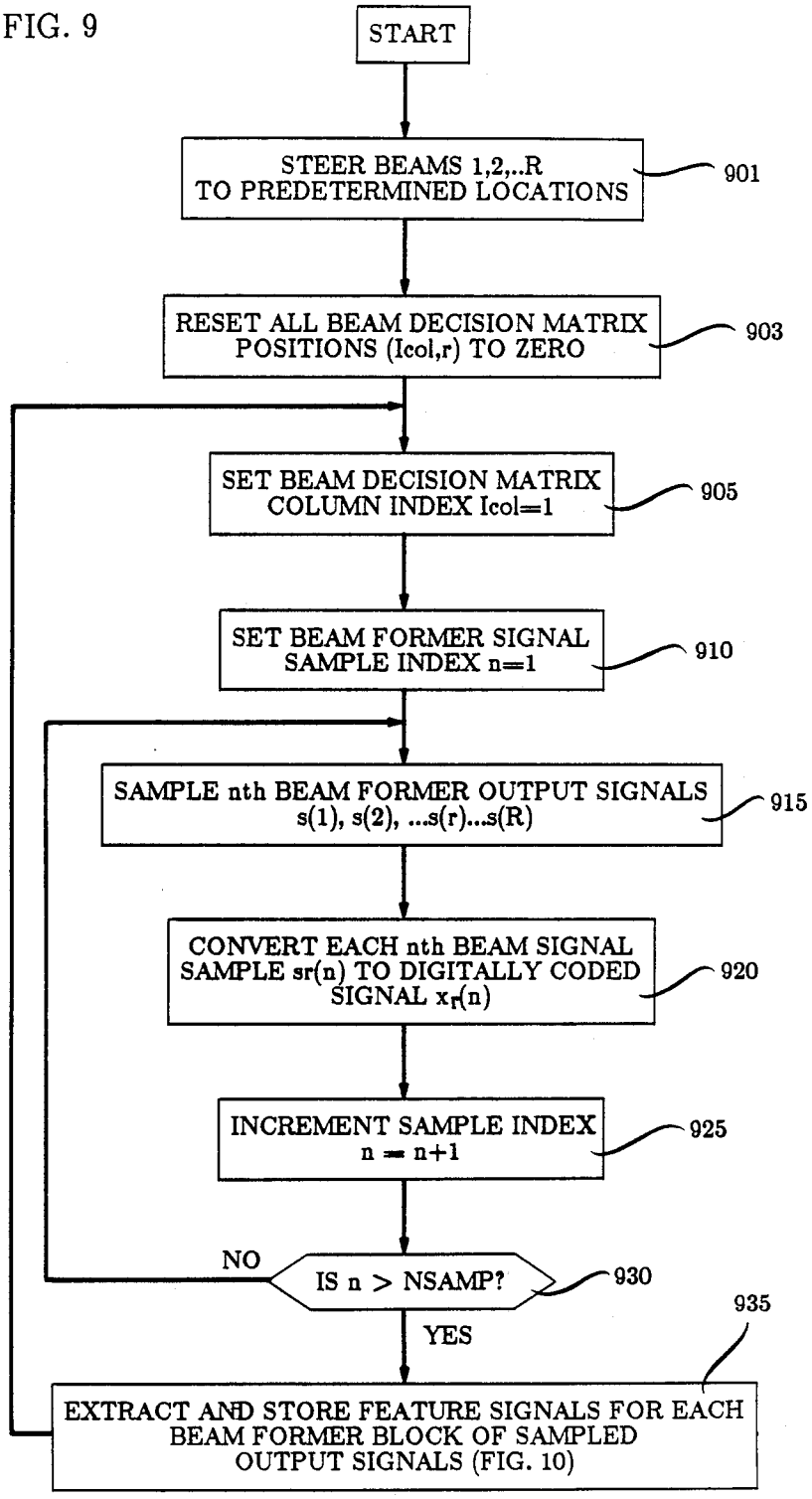

The flow charts of FIGS. 9-12 illustrate the operation of the signal processing arrangement of FIG. 1 in selecting well formed speech pickup locations in a large conference environment such as an auditorium where a plurality of beams are fixedly pointed at predetermined locations. The multiple beam technique is particularly useful where it is desired to concurrently accommodate several talkers who may be at locations covered by different beams. Referring to FIG. 9, the directable beam directional patterns are initially set up (step 901) to point to R locations in a conference environment as described with reference to FIGS. 2 and 3 and the flow chart of FIG. 8. As a result, each of a plurality of beams, e.g., 16, is directed to a predetermined location r in the conference room or auditorium.

Figure 4:
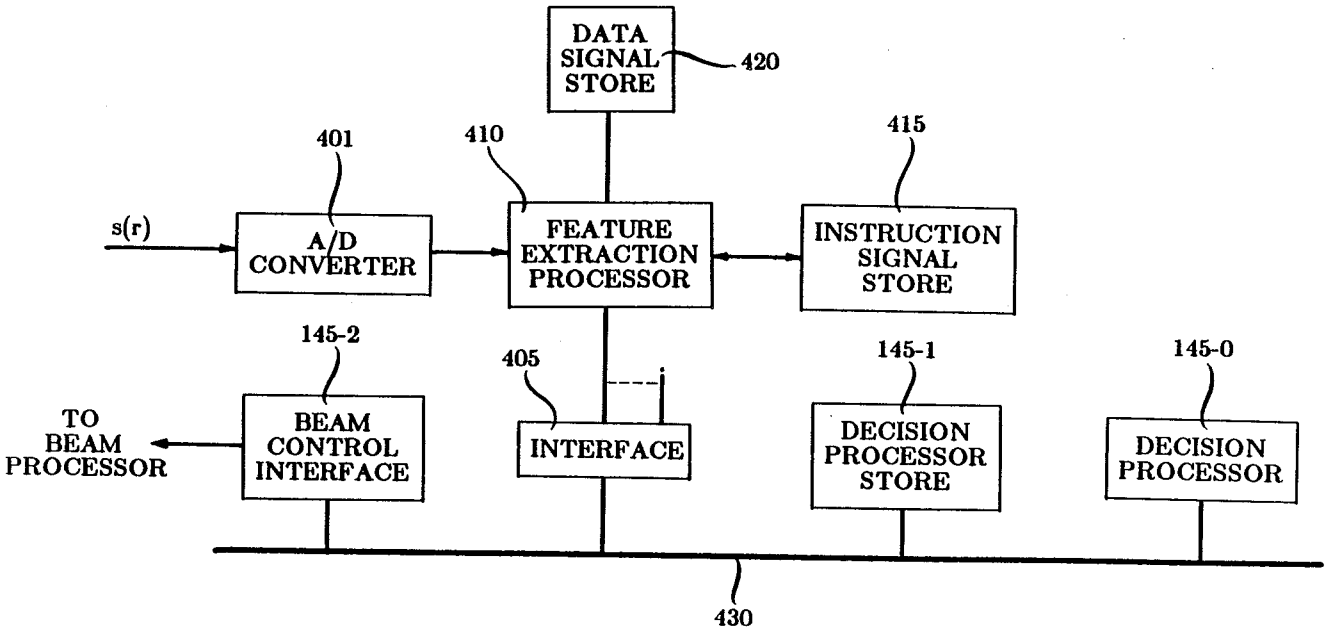
FIG. 4 shows a detailed block diagram of a feature extraction circuit and/or decision processor useful in embodiments of the invention.

The outputs of the beamformer summing circuits 135-1 through 135-R, are supplied to feature extraction circuits 140-1 through 140-R, respectively. A feature extraction circuit, e.g. 140-1, shown in FIG. 4 comprises feature extraction processor 410 which may be the type TMS 320 Digital Signal Processor made by Texas Instruments, Dallas Tex., instruction signal read-only memory 415 for storing control and processing instructions, data signal store 420, analog-to-digital convertor 401 for converting signals from the corresponding summing circuit input at a predetermined rate into digital codes, interface 405 and bus 430. Decision processor shown in FIG. 4 is connected to bus 430 and receives signals from all feature extraction processors 410 via interfaces 405 and bus 430. The decision processor is connected to all feature extractor circuit buses in a manner well known in the art. Decision processor 145 includes microprocessor 145-0, matrix store 145-1, and beam control interface 145-2.

The number of row positions $r=1, 2, \ldots, R$ in each column of matrix store 145-1 corresponds to the number of beams. Initially all positions of the beam decision matrix store are reset to zero (step 903) and the beam position matrix column addressing index is set to $Icol=1$ (step 905). The first (leftmost) column of the matrix store holds the most recently obtained beam position signals while the remaining columns contain signals obtained in the preceding signal sampling iterations. In this way, the recent history of the beam selection is stored. At the end of each iteration, the columns are shifted right one column and the rightmost column is discarded. Beam control interface 145-2 transfers gating signals to source selector 160 and beam control information to beam control processors 150-1 through 150-R.

Signal sample index n is initially set to one by feature extraction processor 410 as per step 910 in FIG. 9. Each feature extraction processor 410 causes its summer output connected to A/D convertor 401 to be sampled (step 915) and digitized (step 920) to form signal $x_r(n)$. All the summers 135-1 through 135-R are sampled concurrently. The sample index n is incremented in step 925 and control is passed to step 915 via decision step 930. The loop including steps 915, 920 and 925 is iterated until a predetermined number of samples NSAMP have been processed and stored. NSAMP, for example, may be 128. After a block k of NSAMP signals have been obtained and stored in data signal store 420, feature signals corresponding to the kth block are generated in step 935 as shown in greater detail in FIG. 10.

Figure 10:
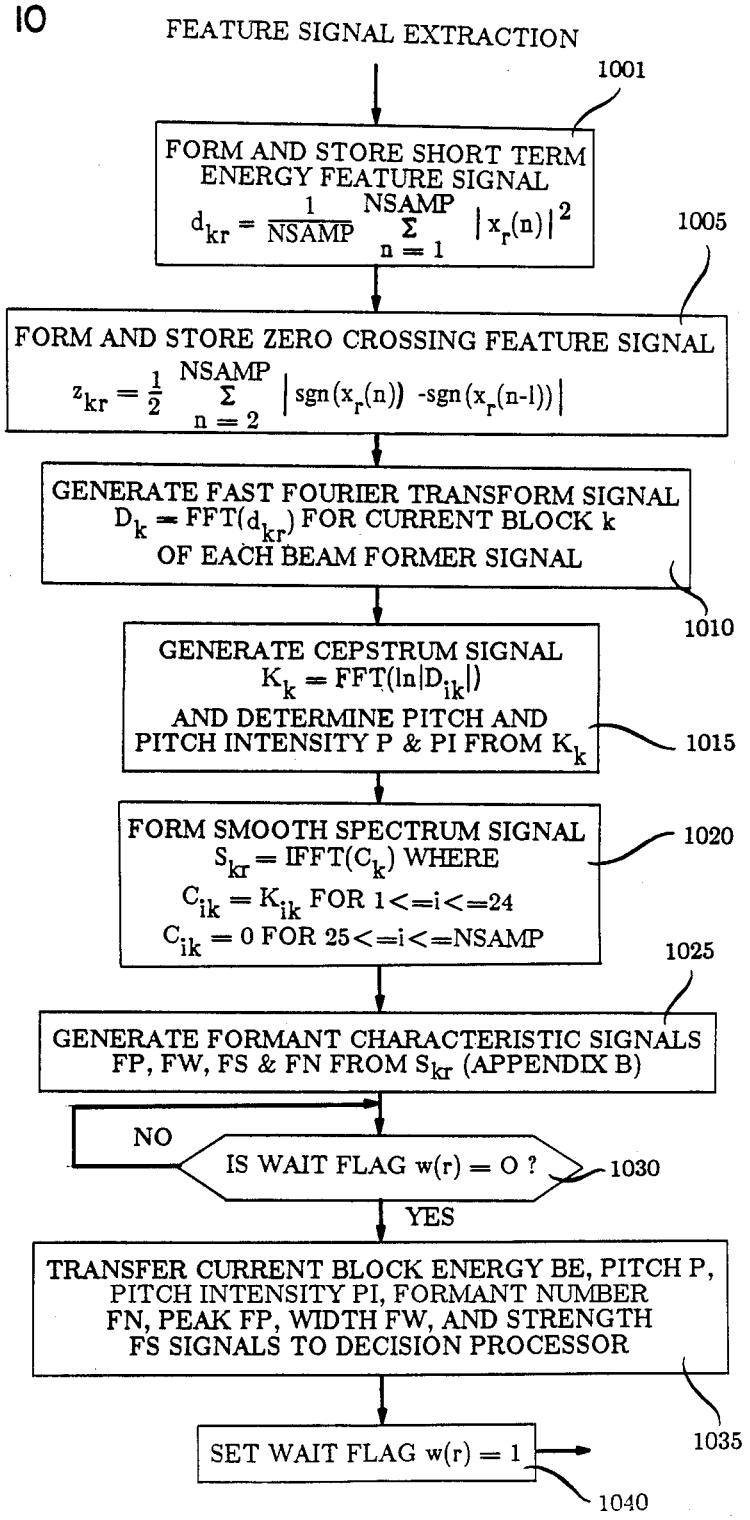

Referring to FIG. 10, a short term energy feature signal is formed in feature extraction processor 410 of each feature extraction circuit (step 1001) according to $$d_{rk} = 1/NSAMP \sum_{n=1}^{NSAMP} (|x_r(n)|)^2 \tag{17}$$

and a zero crossing feature signal is formed (step 1005) as per $$Z_{rk} = \tfrac{1}{2} \sum_{n=2}^{NSAMP} |\mathrm{sgn}(x_r(n)) - \mathrm{sgn}(x_r(n-1))|. \tag{18}$$

In addition to the short term energy and zero crossing feature signals, a smoothed amplitude spectrum signal $S_{kr}$ for the block is generated from a cepstral analysis based on fast Fourier transform techniques as described in *Digital Processing of Speech Signals* by L. R. Rabiner and R. W. Schafer published by Prentice-Hall, Inc., Englewood Cliffs, N.J., and elsewhere.

The analysis signal processing is set forth in steps 1010, 1015, and 1020 of FIG. 10. Pitch P and pitch intensity PI for the current block of sampled signals are formed from the cepstrum signal $K_k$ (step 1015), the smooth spectrum signal $S_{kr}$ is formed in step 1020, and formant characteristic signals are produced from the smooth spectrum signal $S_{kr}$ in step 1025. The generation of the formant characteristic signals is performed according to the instructions set forth in C language form in Appendix B. These formant characteristic signals include a signal FN corresponding to the number of formants in the spectrum, signals FP corresponding to the location of the formant peaks, signals FS corresponding to the formant strength and signals FW corresponding to the widths of the formants. The acoustic feature signals are stored in signal store 420 for use in forming a signal indicative of the presence and quality of speech currently taking place in each of the beam directional patterns. When decision processor 145 is available to process the stored acoustic feature signals generated for beam r, wait flag w(r) is reset to zero and the feature signals are transferred via interface 405 and bus 430 (step 1035). The wait flag is then set to one (step 1040) and control is passed to step 905 so that the next block signals received via A/D converter 401 can be processed. The steps of FIGS. 9 and 10 may be performed in accordance with the permanently stored instructions in the feature extraction and beam processor circuits and are listed in Appendix C.

The flow charts of FIGS. 11 and 12 illustrate the operation of decision processor 145 in selecting and enabling preferred location beams responsive to the acoustic feature signals formed from sampled beamformer signals. In FIGS. 11 and 12, the acoustic feature signals formed in feature extraction circuits 145-1 through 145-R are processed sequentially in the decision processor to determine which beamformer signals should be selected to pickup speech. The results of the selection are stored in beam decision matrix store 145-1 so that speech source selector gates may be enabled to connect the selected beam signals for distribution.

Referring to FIG. 11, decision step 1100 is entered to determine if the current sample block sound feature signals of all beamformers have been transferred to decision processor 145. When the feature signals have been stored in the decision processor, the beam decision matrix row index is set to the first beamformer r=1 in decision processor (step 1101) and the decision processing of the extracted feature signals of the rth beamformer is performed as per step 1105. The decision processing to select pickup locations on the basis of the speech quality of the current block of beamformer signals is shown in greater detail in the flow chart of FIG. 12. In step 1201 of FIG. 12, a signal corresponding to the difference between the short term and long term acoustic energy signals $$M_r=(p\cdot d_{rk})-L_{rk} \tag{19}$$

is generated in the decision processor where p is a prescribed number of sampling periods, $$L_{rk}=\alpha d_{rk}+(1-\alpha)L_{rk} \tag{20}$$

and $\alpha$ is a predetermined number between 0 and 1, e.g. 0.2. The differences between the long and short term sound energies is a good measure of the transient quality of the signal from beam r. If the value of $M_r$ is less than a prescribed threshold MTHRESH (step 1205), the beamformer signal is relatively static and is probably the result of a constant noise sound such as a fan. Where such a relatively static sound is found at location r, step 1265 is entered to set position r of the first column to zero. Otherwise, step 1210 is entered wherein the pitch intensity feature signal is compared to threshold TPI which may, for example, be set for an input signal corresponding to 50 dBA. In the event PI is greater than threshold TPI, the beamformer signal is considered voiced and the beamformer feature signals are processed in steps 1215, 1220, 1225, and 1230. Where PI is less than or equal to TPI, the beamformer signal is considered unvoiced and the beamformer feature signals are processed in accordance with steps 1235, 1240, 1245, and 1250.

For beamformer signals categorized as voiced, the pitch feature signal P is tested in step 1215 to determine if it is within the pitch range of speech. The formant feature signals are then tested to determine if (1) the number of formants corresponds to a single speech signal (step 1220), (2) the formant peaks are within the prescribed range of those in a speech signal (step 1225), and (3) the formant widths exceed prescribed limits (step 1230). If any of the formant features does not conform to the feature of a well defined speech signal, a disabling zero signal is placed in the beamformer row of column 1 of the decision matrix (step 1265).

For beamformer signals categorized as unvoiced in step 1210, steps 1235, 1240, 1245 and 1250 are performed. In steps 1235 and 1240, a signal i(q) representative of the number of successive unvoiced segments is generated and compared to the normally expected limit ILIMIT. As is well known in the art, the number of successive unvoiced segments in speech is relatively small. Where the length of the successive unvoiced segments exceeds a prescribed value such as 0.5 seconds, it is unlikely that the sound source is speech. In steps 1240 and 1245, signals $E_{lf}$ and $E_{hf}$ representative of the low frequency energy and the high frequency energy of the beamformer block signal are formed and the difference therebetween $E_{lf}-E_{hf}$ is compared to the energy difference limit thresholds ELIM1 and ELIM2. This difference signal is a measure of the spectral slope of the signals from the sound source. For speech, the difference should be in the range between 0 and 10db. In the event either signal i(q)>ILIMIT or the energy difference signal is outside the range from ELIM1 to ELIM2, the present beamformer signal is not considered as acceptable speech source. Step 1265 is then entered from step 1240 or 1250 and the beam decision matrix position is set to zero.

If the beamformer signal is voiced and its features are acceptable as well formed speech in steps 1215, 1220, 1225 and 1230, step 1255 is entered from step 1230. If the beamformer signal is unvoiced and its features are acceptable, step 1255 is entered from step 1250. In either case, the short term smoothed spectrum S(r) is compared to the long term smoothed spectrum $$LS_k(r)=\alpha S_k(r)+(1-\alpha)LS_k(r) \tag{21}$$

in decision step 1255 where $\alpha$ is 0.2. If the spectral portions of the short and long term smoothed spectrums exhibit a difference of less than a predetermined amount M, e.g. 0.25 db, the lack of distinct differences indicates that the sound is from other than a speech source so that a zero is entered in the corresponding beam decision matrix position (step 1265). Otherwise, step 1260 is entered from step 1255 and a one is inserted in the decision matrix position for beam r.

Step 1270 is then performed to provide a long term energy feature signal in accordance with equation 20, a short term smoothed spectrum signal $$S_{kr}=IFFT(c_k) \tag{22}$$

where $$C_{ikr}=K_{ik} \text{ for } 1\leqq i\leqq 24$$

$$C_{irk}=\text{for } 23\leqq i\leqq \text{NSAMP}$$

and $$K_{ik}=FFT(\ln|D_{ik}|)$$

and a long term smoothed spectrum feature signal in accordance with equation 21. These signals are generated in the decision processor since the processing is relatively simple and does not require the capabilities of a digital signal processor. Alternatively, the processing according to equation 22 may be performed in the individual feature signal processors.

Referring again to FIG. 11, the feature extraction processor wait flag w(r) is reset to zero (step 1106) and beamformer index signal r is incremented (step 1107) after the decision processing shown in the flow chart of FIG. 12 is completed for feature signals of beamformer r. The loop including steps 1105 (shown in greater detail in FIG. 12), 1106, 1107 and 1110 is iterated until either an enabling or a disabling signal has been inserted in all the beam decision matrix rows r=1, 2, . . . , R of the first Icol=1.

The beam decision matrix column and row indices are then reset to 1 (step 1112) and the loop from step 1114 to step 1130 is iterated to enable the gates of beam speech source selector 160 in FIG. 1 for all beams having a one signal in any of the matrix columns. If the currently addressed decision matrix position contains a one signal (step 1114), the corresponding gate of selector 160 is enabled (step 1116). In accordance with the flow chart of FIG. 11, a beam gate in source selector 160 is enabled if there is at least one "one" entry in the corresponding row of the beam decision matrix, and a beam gate is disabled if all the entries of a row in the beam decision matrix are zeros. It is to be understood, however, that other criteria may be used.

Row index signal r is incremented (step 1118) and the next decision matrix row is inspected until row index r is greater than R (step 1120). After each row of the decision matrix has been processed in decision processor 145, the matrix column index Icol is incremented (step 1125) to start the gate processing for the next column via step 1130. When the last position of the beam decision matrix store has been processed, the beam decision matrix store is shifted right one column (step 1135). In this way, the recent history of the decision signals is maintained in the beam decision matrix. Control is then transferred to step 1100 to repeat the decision processing for the next block of sampled signals from the beamformers. The steps in FIGS. 11 and 12 may be performed in decision processor 145 according to permanently stored instruction code signals set forth in C language in Appendix D hereto.

Figure 13:
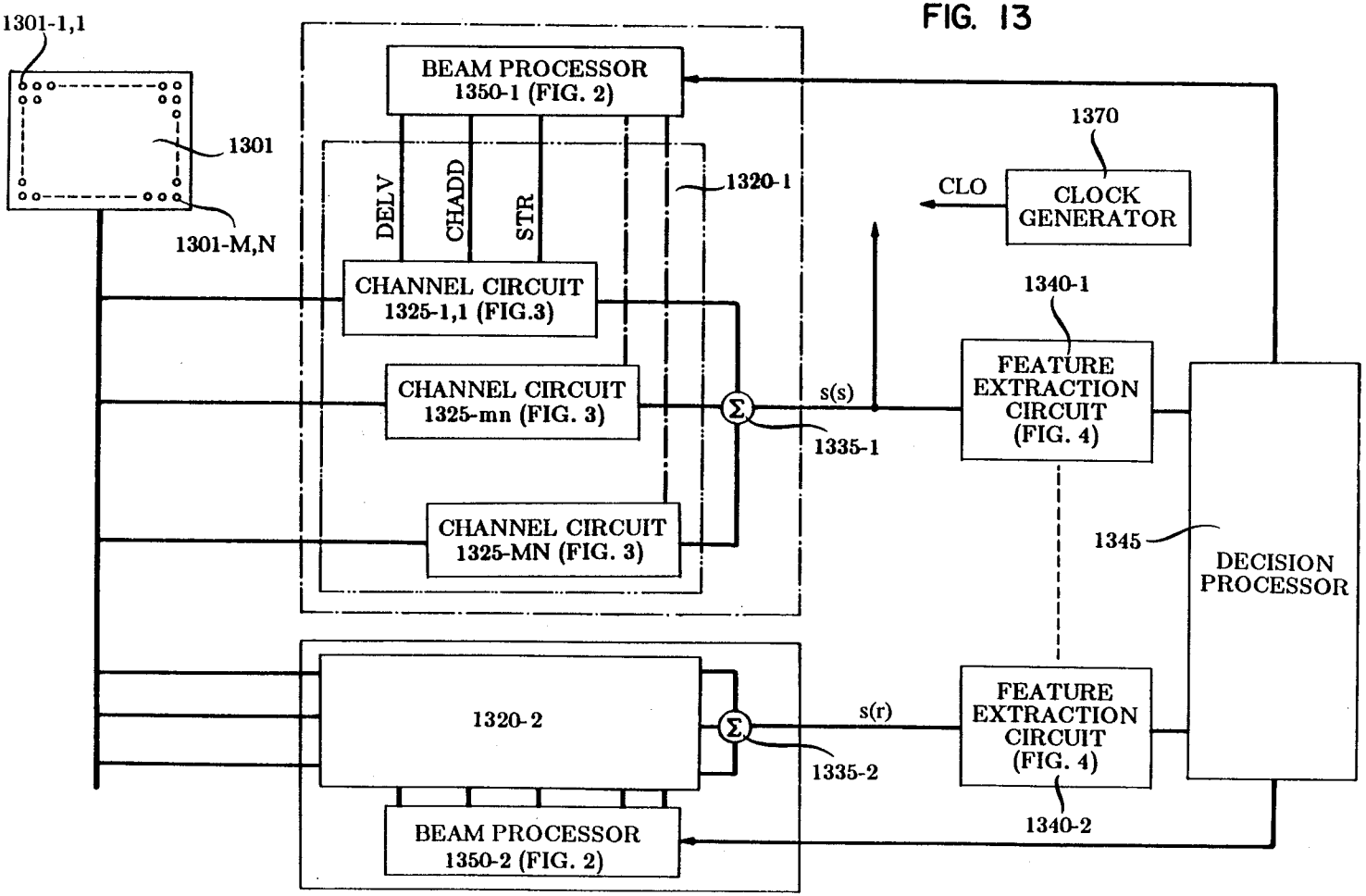
FIG. 13 depicts a general block diagram of another audio signal processing embodiment utilizing scanning to select sound sources that is illustrative of the invention.

FIG. 13 depicts a signal processing circuit that uses beamfomer circuit 1320-1 to pickup and beamformer circuit 1320-2 to select sounds from a preferred speech location. Beamformer 1320-1 is steered to the current preferred location, and beamformer 1320-2 is adapted to scan all locations r of the conference environment so that speech feature signals from the locations may be analyzed to select preferred locations.

Referring to FIG. 13, microphone array 1301 is adapted to receive sound signals from a conference environment as described with respect to microphone array 101 of FIG. 1. The signals from array 1301 are applied to pickup beamformer circuit 1320-1 and scan beamformer circuit 1320-2 in the same manner as described with respect to FIG. 1. In the arrangement of FIG. 13, however, scan beamformer 1320-2 is controlled by beam processor 1350-2 to sequentially scan the r locations of the conference environment and pickup beamformer 1320-1 is steered to selected locations by beam processor 1350-1. The steering and scanning arrangements of the beam processor and channel circuits of FIG. 13 are substantially as described with respect to FIG. 1 except that the directional patterns are modified periodically under control of decision processor 1345 and beam processors 1350-1 and 1350-2 to accomplish the necessary scanning and steering.

The signals at the outputs of channel circuits 1325-11 through 1325-MN are summed in summer 1335-1 to produce the pickup beamformer output signal s(s). Similarly, the signals at the outputs of channel circuits 1327-11 through 1327-MN (not shown) produce the scan beamformer output signal s(r). Signal s(s) corresponding to the sound waves from only the selected location as defined by the beam pickup beam directional pattern is the output signal of the arrangement of FIG. 13 and is also applied to feature extraction circuit 1340-1. Signal s(r) is supplied to feature extraction circuit 1340-2. The acoustic feature signals generated in these feature extraction circuits are used by decision processor 1345 to direct the steering of the scan beam via beam processor 1350-2. The operation of the feature extraction circuits and the beam processor circuits are substantially the same as described with respect to FIGS. 2 and 4 and clock generator 1370 serves the same function as generator 170 in FIG. 1.

Figure 14:
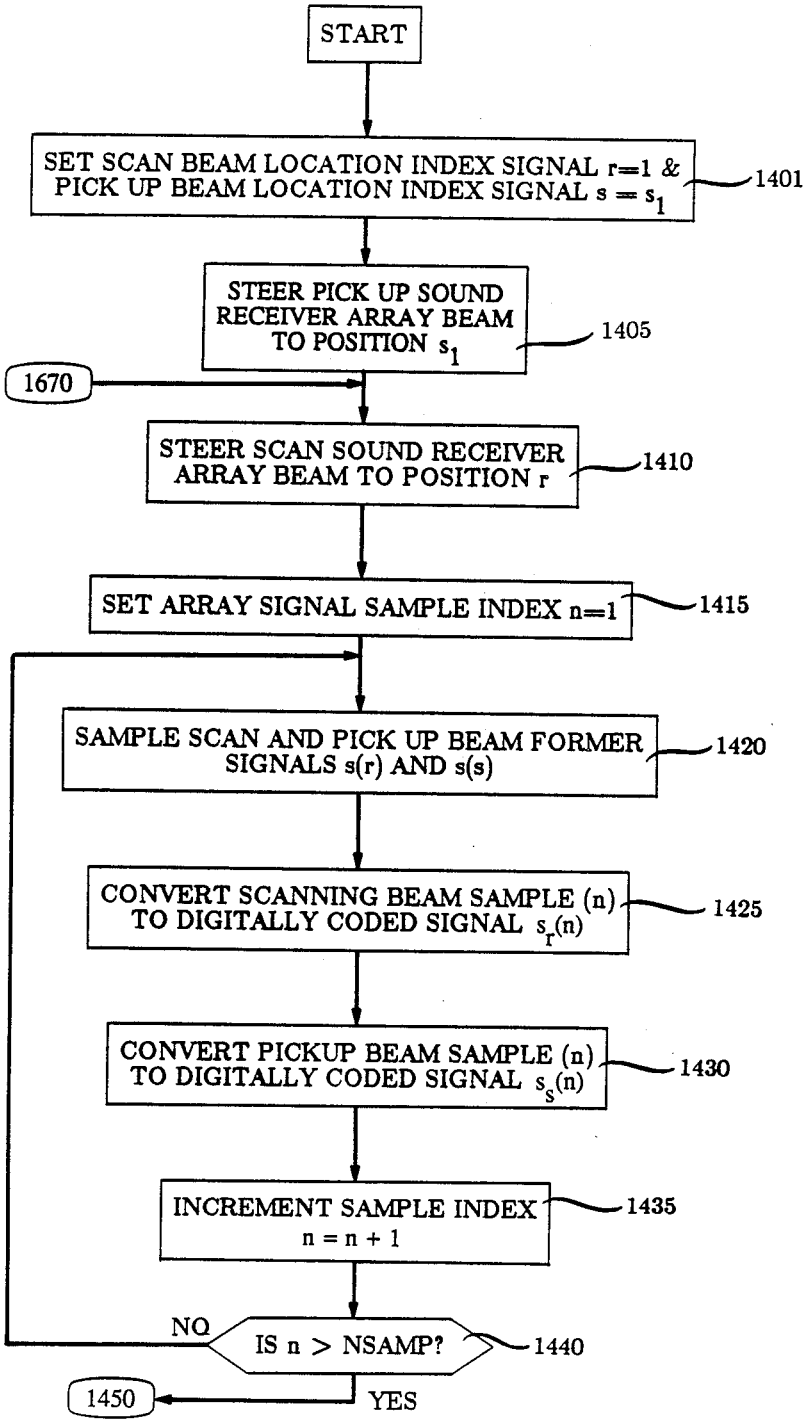
FIGS. 14–16 show flow charts illustrating the operation of the circuit of FIG. 13 in selecting sound pickup locations.
Figure 15:
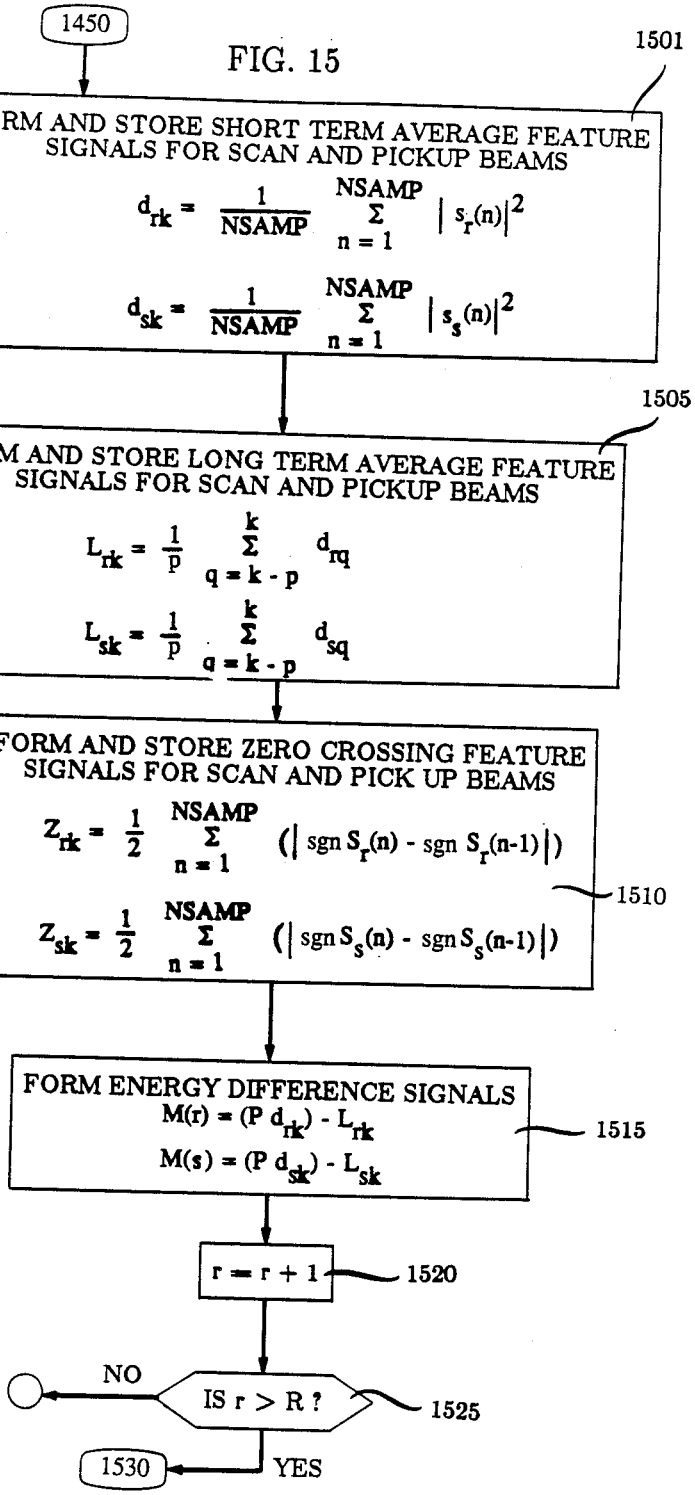
Figure 16:
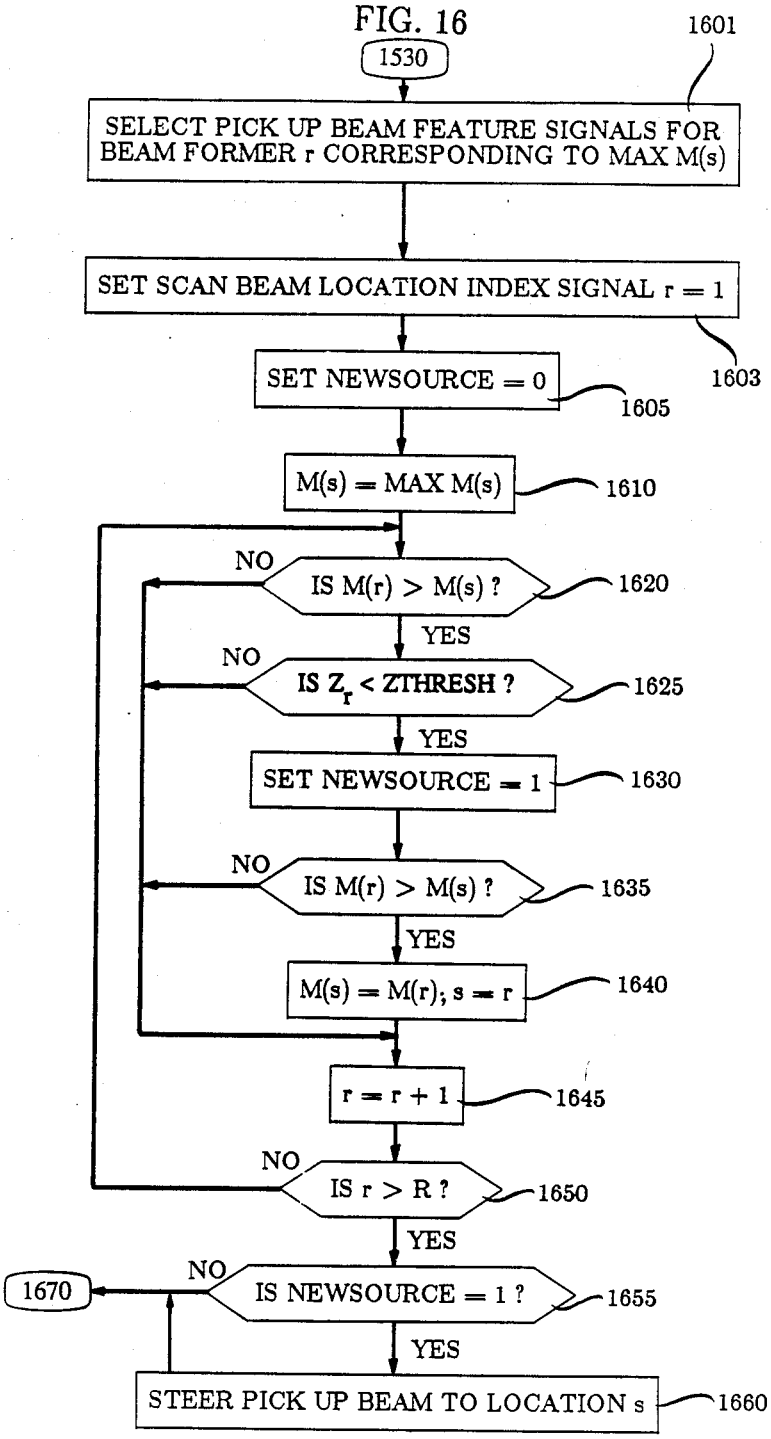

The flow charts of FIGS. 14–16 illustrate the operation of signal processing arrangement of FIG. 13 in which the pickup beamformer is directed to a detected well formed speech pickup location in a large conference environment, while the scan beamformer is used to continuously scan the prescribed locations in the conference environment at a rapid rate to determine where the pickup beamformer will be directed. Feature signals are formed responsive to the signals from scan and pickup beamformers, and the feature signals are processed to determine the current best speech signal source location. This two beam technique is more economical in that it requires only two beamformer circuits and two beam processors. Referring to FIG. 14, the directable scan beam location index signal is initially set to first location r=1 and the pickup beam location index signal is initially set to point to a particular location s=s1 (step 1401). The pickup sound receiver beamformer is adjusted by its beam processor to point to location s1 (step 1405), and the scan beamformer is adjusted to point to location r=1 (step 1410) as described with reference to FIGS. 2 and 3 and the flow chart of FIG. 8.

The sound signal outputs of the beamformer summing circuit 1335-1 for the pickup beam and 1335-2 for the scanning beam are supplied to feature extraction circuits 1340-1 and 1340-2. As described with respect to FIG. 4, each feature extraction circuit comprises feature extraction processor 410, instruction signal read-only memory 415 for storing control and processing instructions, data signal store 420, analog-to-digital converter 401 for converting signals from its summing circuit input at a predetermined rate into digital codes, interface 405 and bus 430. Decision processor shown in FIG. 4 is connected to bus 430 and receives signals from the two feature extraction processors 410 via interfaces 405 and bus 430.

Signal sample index n is initially set to one by feature extraction processor 410 as per step 1415 in FIG. 14. Each of the two feature extraction processors 410 causes the summer output connected to its A/D converter 401 to be sampled (step 1420) and digitized (steps 1425 and 1430) to form signal $s_r(n)$ for the scan beamformer and $s_s(n)$ for the pickup beamformer. Summers 1335-1 and 1335-2 are sampled concurrently. The sample index n is incremented in step 1435, and control is passed to step 1420 via decision step 1440. The loop including steps 1420, 1425, 1430, 1435, and 1440 is iterated until a predetermined number of samples NSAMP have been processed and stored. After a block k of NSAMP signals have been obtained and stored in data signal store 420, beamformer sound feature signals corresponding to the kth block are generated as shown in greater detail in FIG. 15.

Referring to FIG. 15, a short term energy feature signal is formed in feature extraction processor 410 of the scan feature extraction circuit according to $$d_{rk} = 1/NSAMP \sum_{n=1}^{NSAMP} (|s_r(n)|)^2 \tag{23}$$

and the pickup feature extraction circuit $$d_{sk} = 1/NSAMP \sum_{n=1}^{NSAMP} (|s_s(n)|)^2 \tag{24}$$

as per step 1501. After P, e.g., 10, short term energy average feature signals have been stored, long term energy feature signals are formed for the scan beamformer $$L_{rk} = 1/P \sum_{q=k-P}^{k} (d_{rq}(n)) \tag{25}$$

and the pickup beamformer $$L_{sk} = 1/P \sum_{q=k-P}^{k} (d_{sq}(n)) \tag{26}$$

as per step 1505. A zero crossing feature signal is generated for each beamformer signal (step 1510) as per $$Z_r = \sum_{n=2}^{NSAMP} \tfrac{1}{2}\,\mathrm{sgn}(s_r(n)) - \mathrm{sgn}(s_r(n-1)) \tag{27}$$

$$Z_s = \sum_{n=2}^{NSAMP} \tfrac{1}{2}\,\mathrm{sgn}(s_s(n)) - \mathrm{sgn}(s_s(n-1)) \tag{28}$$

and a signal corresponding to the difference between the short term energy and the long term energy signals is generated for each beamformer block of sampled signals as per $$M_{rk}=(Pd_{rk})-L_{rk} \tag{29}$$

$$M_{sk}=(Pd_{sk})-L_{sk} \tag{30}$$

in step 1515.

The energy difference signal as aforementioned is a measure of change in the beamformer signal during the sampled block interval. The lack of change in the difference signal reflects a constant sound source that is indicative of sounds other than speech. The zero crossing feature signal is indicative of the periodic pitch of voiced speech. The energy difference and zero crossing feature signals are stored in memory 420 for use in decision processor 145-0. Location index signal r is incremented in step 1520 and the beamformer feature signals for the next location are produced in accordance with the flow charts of FIGS. 14 and 15 until the last location R has been processed (step 1525).

After feature signals for all the locations in the conference environment have been stored, the decision processor selects the pickup beamformer location for the current scan as illustrated in FIG. 16. Referring to FIG. 16, the energy difference signals obtained for each scanned location are compared to determine the maximum of the pickup beam energy difference signals M(s) (step 1601). The scan beam location index is reset to r=1 (step 1603), a flag signal NEWSOURCE which indicates whether one of the scanned locations is a preferred speech source is set to zero (step 1605), and the pickup beamformer energy difference signal M(s) is initially set to the MAX M(s) (step 1610).

The energy difference signal M(r) is compared to threshold value M(s) in step 1620, and the zero crossing signal z(r) is compared to a zero crossing threshold ZTHRESH in step 1625. If the criteria of steps 1620 and 1625 are both satisfied, the rth location is a preferred speech location candidate and NEWSOURCE flag signal is set to 1 (step 1630). Otherwise location index incrementing step 1645 is entered from decision step 1620 or 1625. Where the feature signal criteria have been met, decision step 1635 is entered to select the maximum of the scanned location energy difference signals. When the current M(r) signal is greater than the previously found maximum, its value is stored as M(s), and the pickup location corresponding to its location r is stored as the selected pickup location s in step 1640.

When M(r) for the current location is not greater than the previously determined maximum M(s), location index incrementing step 1645 is entered directly from step 1635. The loop from step 1620 to step 1650 is iterated until all location feature signals have been processed. When decision step 1655 is entered, the preferred location has been selected on the basis of comparing the energy difference and zero crossing feature signals for the locations pointed to by the scanning and pickup beams. In the event that the current location pointed to by the pickup beam is a preferred speech source, the NEWSOURCE flag signal is zero, and the next scan is started in step 1410 without altering the location pointed at by the pickup beam. If the NEWSOURCE flag signal in step 1655 is one, decision processor transmits the preferred pickup location signal s to beam processor 1350-1, and the pickup beamformer is steered to that location (step 1660). The next scan is then started by reentering step 1410 of FIG. 14. The steps shown in FIGS. 14–16 may be implemented by the permanently stored program instruction codes set forth in C language form in Appendix E. In accordance with the scanning embodiment illustrated in FIGS. 13–16, the environment is scanned periodically e.g., every 200 milliseconds so that the preferred speech source location may be altered without disruption of the speech signals at the output of summer circuit 1335-1 of FIG. 13.

The invention has been described with reference to particular embodiments thereof. It is to be understood that various other arrangements and modifications may be made by those skilled in the art without departing from the spirit and scope of the invention.

APPENDIX A

```
(Microphone Beam Array Steering)
/*This subroutine steers the desired beam to the    */
/*angle (phi,theta), where phi and theta are indices*/
/*for previously defined steering angles. The delay table*/
/*delv is in ROM and is arranged so that the first value*/
/*corresponds to the delay for the first microphone at*/
/*the first steering direction. The next steering   */
/*direction delay data begins at the entry of the*/
/*delay table delv equal to the number of microphones*/
/*in the array (nmics). The size of the delay array delv*/
/*is therefore equal to the number of microphones times*/
/*the number of desired steering locations.*/
steer(pd,nmics)
{
int *pd,nmics;
#define NMICS ddd   /* where ddd is the number of microphones*/
#define R   ddd   /* number of beam locations to store */
/*
i/o bus i/o
*/
struct iobus{
short DSPC;
short IOCC;
short IOP1;
short IOP2;
};
#define IOBREG register struct iobus *IOB=
(struct iobus *)0×ffee000,
int chadd,pd;   /* chadd is the channel address, pd is a data pointer*/
IOBREG
for(chadd= 0; chadd < nmics; chadd++) IOB -
> DSPC= *pd++;
return;
```

-continued

```
}
```

APPENDIX B

```
/* function to calculate the formant frequencies and the  */
/* the formant bandwidths as well as the number of formants */
genfeature(buf,fn,fp,fw)
#define MAXWIDTH ddd /* define the maximum formant
half-width */
#define NSAMP ddd /* define the sample size of cepstral
coefficients*/
#define NFMT  ddd /* define maximum number of formants to
check */
#define R  ddd /* define the number of multiple beams  */
int buf[NSAMP][R];
{
int fp[NFMT][R],fw[NFMT][R],fn[NFMT][R];
int i,ii,iflag,n,peak,num,ilflag,ihflag,itest,nn,r;
ii=num=ilflag=ihflag=0;
for(r=0; r<R; r++){
for(n=1; n<NSAMP; n++){
if(buf[n-1][r]-buf[n][r] <=0)iflag=-1;
if(buf[n-1][r]-buf[n][r] > 0) iflag=1;
if(n == 1)itest=iflag;
if(itest !=iflag){
fn[ii][r]=n;
fp[ii][r]=buf[n][r];
num++;
}
}
for(n=0; n<num; n++){
nn=fn[n][r];
peak=fp[nn][r];
ihflag=ilflag = 0;
for(ii=1;ii < MAXWIDTH; ii++)
if (ilflag == 0 && (nn -ii) > 0 ){
if(buf[nn-ii][r]/peak <= 2)ilflag=ii;
 }
if(ihflag == 0 && (nn+ii) < NSAMP){
if(buf[nn +ii][r]/peak <= 2)ihflag=ii;
  }
fw[n][r]=ilflag+ihflag;
   }
}
}
```

APPENDIX C

Multiple Beam Array Sound Location

```
#define NCOLS ddd /* ddd is the number of past samples to
average over*/
#define NSAMP ddd /* NSAMP is the number of samples to
obtain */
#define NFFT ddd  /* NFFT is the FFT size */
#define ADRATE ddd /* ADRATE is the AD sampling rate */
#define NMICS ddd /* ddd is the number of microphones in the
array*/
#define R ddd  /* ddd is the number of beams formed */
#define NFMT ddd  /* maximum bumber of formants to examine */
#define PH_MIN ddd /* minimum phi direction cosine angle */
#define PH_MAX ddd /* maximum phi direction cosine angle */
#define TH_MIN ddd /* minimum theta direction cosine angle */
#define THMAX ddd /* maximum theta direction cosine angle */
#define PH_STEP ddd /* phi direction cosine angle increment */
#define TH_STEP ddd /* theta direction cosine angle increment */
#include "struct.h" /* include file for i/o delay hardware control */
#include "ad_clk.h" /* include file for AD and real-time
clock control */
main(){
int i,buf[NSAMP][R],n,r,icol,iflag[R],iflag1[R];
int q[NCOLS][R],drk[R],zrk[R];
int FW[NFMT][R],FN[NFMT][R],FP[NFMT][R];
int delv[R][NMICS],PI[R],P[R];
i=0;
 /* set up delay table for all look directions */
for (phi=PHI_MIN; phi <=PH_MAX; phi=phi+PH_STEP){
for (theta=TH_MIN; theta <=TH_MAX; theta=theta+
TH_STEP){
delay(&delv[i][0]);
i++;
}
}
 /* steer R beams to predetermined locations */
for(r=0; r < R; r++){
steer(&delv[r][0],NMICS); /* send appropriate delays to */
/* delay hardware for beam r */
```

-continued

```
  }
for(icol=0; icol < NCOLS; icol++){
for(r=0; r < R; r++)q[icol][r]=0; /* initial q matrix to 0 */
}
icol=0;
do {
for(r=0; r < R; r++){
drk[r]=zrk[r]=0; /* initilize dat arrays to 0 */
 }
 /* get NSAMP a/d values from all R beams at the rate
ADRATE */
adx(&buf[0][0],NSAMP,ADRATE,stchn,endchn);
for(r=0; r < R; r++){
 /* calculate short time energy and qero-crossings */
for (n=; n < NSAMP; n++){
drk[r]=drk[r]+buf[n][r]*buf[n][r];
iflag[r]=1;
if(buf[n][r] < 0)iflag[r]=-1;
if(n > 0 && iflag[r]!=iflag1[r])zrk[r]=zrk[r]+1;
iflag1[r]=iflag[r];
}
  }
fft(&buf[0][0],NFFT); /* calculate fft of input signal */
/* for all r beams */
cepstrum(&buf[0][0]&PI[0]&P[0]);
/* calculate cepstrum find pitch */
/* and pitch intensity */
ifft(&buf[0][0]); /* inverse fft and obtain smoothed cepstral */
/* coefficients */
genfeature(&buf[0][0],&FN[0][0],&FP[0][0],&FW[0][0]);
 /* generate feature signals */
 /* extract signal features for speech present decision */
feature(&q[0][0],&buf[0][0],&drk[0],&zrk[0],&PI[0],&P[0],
&FN[0][0],&FP[0][0],&FW[[0][0],NFFT);
for(r = 0; r < R; r++){
for(n = 0; n < NCOLS; n++){
if(q[n][r] == 1){
enable(r); /* enable beam r */
}
  }
    }
}while (1);
/* timer */
/* rate: in mms => 100 == 100 mms = 0.1 */
/* loop: number of rate */
#include "struct.h"
timer (repeat, rate)
short repeat,rate;
{
CLKREG
CLK -> pcnt = -rate;  /* turns clock on */
CLK -> pcsr = 0xB;  /* repeated interval,go */
while (repeat--) {
while( ( CLK -> pcsr & 0 × 80 ) == 0);
CLK -> pcsr = 0 × B;
}
CLK -> pcsr = 0;  /* turns clock off */
}
/* include file ad_clk. */
/* control structure for andromeda adc */
/* control structure for andromeda adc12 board */
struct adc {
short acsr;
short abuf;
};
#define ADCREG register struct adc *ADC =
(struct adc *)0×fff100;
/* abuf bits
0-3number of trancation channel
adcsr bits
13sequence enable
12burst enable
11-8channel number
7done
5clock start enable
4external start enable
1truncation enable
Ogo: real time clock controlled or must be set */
/* control structure for prtc11 programmable real time clock */
struct pclk {
short pcsr;
short pcnt;
```

-continued

```
};
#define CLKREG register struct pclk *CLK =
(struct pclk *)0×fff110;
/* pcsr bits
7clock overflow
5—3rate select(001=1 Mhz,100=1 Khz)
2—1mode(01=repeated interval,00=single interval)
0go */
/* implies 0×B for 1us continuous, 0×21 for 1ms single */
/* include file struct.h */
/* i/o bus i/9 */
struct iobus1 {
short DSPC1;
short IOCC1;
short IOP11;
short IOP21;
};
struct iobus2 {
short DSPC2;
short IOCC2;
short IOP12;
short IOP22;
};
#define IOBREG1 register struct iobus1 *IOB1 =
(struct iobus1 *)0×ffe000;
#define IOBREG2 register struct iobus2 *IOB2 =
(struct iobus2 *)0×fff000;
/* subroutine delay — calculate delay values for array */
#define nmics 380
delay (del,phi,theta)
int *del,phi,theta;
{
int delmin,del2min,ij,n;
static int mictab[] = {d1,d2,d3, . . . , dn};
{
del2min=200;
delmin=200;
phi=phi — 3;
theta=theta — 3;
for]= 0; n < nmics ;n++){
ij=2*n;
del[n]= ((mictab[ij]+25)*theta+((mictab[ij+1]+250*phi);
if(del[n] <= delmin)delmin = del[n];
  }
for(n = 0; n < nmics; n++){
del[n] = 113 + delmin — del[n];
if(del[n] <= del2min)del2min = del[n];
}
del2min = del2min/2;
if(del2min < 0){
for(n = 0; n < nmics ;n++){
del[n] = del[n]— del2min;
if(del[n] > 113)del[n] = 125;
if(del[n] < 0)del[n] = 125;
  }
 }
return;
}
/* Subroutine steer */
/* This subroutine steers the desired beam to the    */
/* angle (phi,theta), where phi and theta are indices */
/* for previously defined steering angles. The delay table*/
/* delv is in ROM and is arranged so that the first value */
/* corresponds to the delay for the first microphone at */
/* the first steering direction. The next steering    */
/* direction delay data begins at the entry of the*/
/* delay table delv equal to the number of microphones */
/* in the array (nmics). The size to the delay array delv */
/* is therefore equal to the number of microphones times */
/* the number of desired steering locations.*/
steer(pd,mnics)
{
int *pd,nmics;
#define NMICS ddd /* where ddd is the number of micrrophones */
#define R  ddd /* number of beam locations to store */
/*
i/o bus i/o
*/
struct iobus {
short DSPC;
short IOCC;
short IOP1;
short IOP2;
};
#define IOBREG register struct iobus *IOB =
(struct iobus *)0×ffe000;
int chadd,pd;   /* chadd is the channel address, pd is a data
pointer */
IOBREG
for(chadd = 0; chadd < nmics; chadd++)IOB —> DSPC =
*pd++;
return;
}
/* Subroutine adx — get A/D values from A/D converter */
#include "ad_clk.h"
adx (buf,wc,rate,startch,truncch) /* (array, # samples,rate, #
channels) */
register short *buf;
short rate,startch,truncch;
register long wc;
  {
register short buf1;
ADCREG
 CLKREG
  /* enable adc */
ADC—>acsr = 0
while (ADC—>ascr & 0×80)!=0)*buff = ADC—>abuf;
ADC—>ascr = 0×2022 + 256*starch;
/* trunc mode: start chan */
ADC—>abuff = truncch;
/* start clock */
CLK—>pcnt = —rate;
CLK—>pcsr = 0 × B;
while (wc){
/* wait for convert complete */
while ((ADC—>acsr & 0 × 80) == 0);
buf1 = (ADC—>abuf)<<4;

if(buf1 > 16384) printf("\ n\ r!! input out of range?
%d (16384<   >32768)",buf1);
*(buf++) = buf1 >> 4;
wc——;
}
/* turn off clock */
CLK—>pcsr = 0;
}
```

APPENDIX D

Multiple Beam Array Sound Location Feature Processing

```
/* function to decide if speech sources are present */
feature(q,buf,drk,zrk,pi,p,fn,fp,fw,nfft)
int q[NCOLS][R],buf[NSAMP][R],drk[R],zrk[R];
int pi[R],p[R],fn[R],fp[NFMT][R],fw[NFMT][R],nfft;
#define NSAMP /* number of samples in data array */
#define R /* number of multiple beams formed */
#define NFMT /* maximum number of formant frequencies to
examine */
#define ALPHA ddd /* constant variable for long time averaging */
#define BETA ddd /* constant variable for long time averaging */
#define ILIM ddd /* index indicating maximum frequency bin */
#define MTHRESH ddd /* threshold for transient data decision */
#define TP ddd /* expected pitch frequency */
#define E ddd /* maximum pitch deviation */
#define TPI ddd /* pitch intensity threshold */
#define LOLIMIT ddd /* Low frequency energy cutoff bin */
#define HILIMIT ddd /* High frequency energy cutoff bin */
#define ILIMIT ddd /* unvoiced segment maximum count */
#define ELIM1 ddd /* Lower threshold bound for energy
difference */
#define ELIM2 ddd /* Higher threshold bound for energy
difference */
#define DEVTHRESH ddd /* deviation threshold for long and
short spectra */
#define NCOLS /* Number of columns in q matrix */
{
int m[R],ii,i,n,r,ipflag,iwflag,elf,ehf,iuflag,abse;
int diff,dev;
static int le[R],ls[ILIM][R],ipos;
/* static variables to set formant frequency corner frequencies */
/* and formant bandwidth limits    */
static int fplo[NMAX]={ddd1,ddd2 . . . dddn};
static int fphi[NMAX]={ddd1,ddd2 . . . dddn};
static int fwhi[NMAX]={ddd1,ddd2 . . . dddn};
static int fwhi[NMAX]={ddd1,ddd2 . . . dddn};
for(r=0; r<R; r++){
```

-continued

```
m[r]=le[r]-pk*drk[r];
if(m[r] <= MTHRESH)goto nospeech;
if(pi[r] < TPI)goto unvoiced;
iuflag[r]=0;
if(p[r] < TP-E p[r] > TP+E)goto nospeech;
if(fn[r] < 3 fn[r] >4)goto nospeech;
ipflag=1;
iwflag=1;
/* check to see if formants fall incorrect bands */
for(i== 0; i  fn[r]; i++){
if(fp[i][r] < fplo[i] fp[i][r] >fphi[i])ipflag=0;
if(fw[i][r] < fwlo[i] fw[i][r] >fwhi[i])iwflag=0;
  }
if(ipflag == 0)goto nospeech;
if(iwflag == 0)goto nospeech;
goto bypass;
unvoiced:if(iuflag[r] == 1)iq[r]++;
/* count number of successive unvoiced segments */
iuflag[r]=1;
if(iq[r] > ILIMIT)goto nospeech;
/* calculate low and high frequency energy */
for(i=0; i<ILIM;i++){
if(i < LOLIMIT)elf=elf+buf[i][r];
if(i > HILIMIT)ehi=ehf+buf[i][r];
  }
abse=elf-ehf;
if((elf - ehf) < 0)abse=ehf-elf;
if(ELIM1 < abse && abse < ELIM2)goto nospeech;
bypass:dev = 0;
/* examine difference between long and short-time average */
for(i=0; i<ILIM; i++){
diff=fub[i][r] - lrk[r];
if(diff < 0)diff = -diff;
dev = dev + diff;
}
if(dev < DEVTHRESH)goto nospeech;
q[ipos][r]=1;
goto update;
nospeech:q[ipos][r]=0;
/* update long-term average */
update:le[r]=ALPHA*drk[r] + BETA*le[r];
for(i=0;i < ILIM; i++){
ls[i][r]= ALPHA*buf[i][r] + BETA*ls[i][r];
}
}
ipos++;
if(ipos > NCOLS)ipos=0;
}
```

APPENDIX E

Scanning Beam Sound Location

```
#define NMICS 380 /* define number of microphones */
#define NS  /* number of total samples obtained each time */
#define NSAMP 50 /* define the number of samples per channel */
#define NLTA 10 /* number of short time
averages for long time average */
#define NA 5 /* number of angles that array steers to */
#define AVERAGE 3 /* number of scan beam sweeps for short
time average */
#define TH_MIN 1 /* define minimum and maximum angles to
steer the */
#define THMAX 5 /* scan beam and the transmission beam.
These angles */
#define PH_MIN 1 /* are determined from the discrete angles
that have */
#define PHMAX 5 /* previously been chosen. There are 25
possible angles. */
#define NLOOK 25 /* number of scan beam look directions */
#define ADDABUF 50 /* number of AD samples to obtain each time
*/
#include "struct.h" /* include file for i/o to delay hardware setup */
#include "ad_clk.h" /* include file for AD and real-time clock
control */
main(){
int n,q,k,sr[NSAMP],ss[NSAMP],zrk[NA],zsk[NA],r,s;
int newsource,m[NA],drk[NA],dsk[NA],lrk[NA],lsk[NA];
int zthresh,phi,theta,delv[NA][NMICS];
int pd1,pd2,buf[NS],am1,am2,pbuf,chadd;
int avs[NA][NLTA],avr[NA][NLTA],zpav;
int nszero,nrzero,iflag,iflag1,iflag2,iflag3;
IOBREG
r=0; /* set scan beam location index to 0 */
s=12; /*set tranmission beam to point straight ahead */
zpav=0; /* set up storage pointer for short time average array */
  /* set up the delay table delv to hold all of the channel
address and delay values for every search location */
for(phi=PH_MIN; phi<=PH_MAX; phi=phi+PH_STEP){
for(theta=TH_MIN; theta<=TH_MAX; theta=theta+
THC_STEP){
delay(&delv[i][0],phi,theta);
i++;
}
}
/* steer tranmission beam to initial position */
pd2=&delv[s][0];
for(chadd=1; chadd <= NMICS;CHADD++)IOB -
>DSPC2 = *pd2++;
  do{
for(r=0; r<NLOOK; r++){
zsk[r]=zrk[r]=drk[r]=dsk[r]=0;
}
for(ii=1, ii<=AVERAGE;ii++){
for(r=0; r < NLOOK; r++){
/* steer scanning beam to position r */
pd1 = &delv[r][0];
for(chadd=1; chadd <= NMICS; chadd++)IOB1 -> DSPC1 =
*pd1++;
CLK -> pcsr =0;
/* get AD samples from scan and tranmission beams */
adx(&buf[0],(long)ADDABUF,ADDARATE,0,1);
  /* put ADDABUF AD samples at ADDARATE in buf, starting
with channel 0 and ending on channel 1  */
pbuf = &buf[0];
am1 = 0;
am2 = 0;
iflag=0;
iflag2=0;
nrzero=0;
nszero=0;
for(i=0; i<ADDABUF;i++,*pbuf++) {
if(*pbuf < 0){
am1 = am1 - *pbuf;
iflag=-1;
}
else {
am1=am1+*pbuf;
iflag=1;
}
if(i > 1 && iflag !=iflag1)nszero++;
iflag1=iflag;
*pbuf++;
if(*pbuf < 0){
am2 = am2 - *pbuf;
iflag2=-1;
}
else {
am2=am2+*pbuf;
iflag2=1;
}
if(i > 1 && iflag2 !iflag3)nrzero++;
iflag3=iflag2;
}
/* accumulate short-time magnitude average */
drk[r] = drk[r]+am1/ADDABUF;
dsk[r] = dsk[r]+am2/ADDABUF;
/* accumulate zero crossings */
zrk[r] = zrk[r]+nrzero;
zsk[r] = zsk[r]+nszero;
}
 }
/* update the long time averages */
for(r=0, r<NLOOK; r++){
pavs=&avs[r][0]+zpav; /* pointer to ref short time storage */
pavr=&avr[r][0]+zpav; /* pointer to scan short avg */
*pavr= drk[r];
*pavs= dsk[r];
lrk[r]=lrk[r]+*pavr; /* update long time average */
lsk[r]=lsk[r]+*pavs; /* update long time average */
if( zpav < NLTA) pavr++;
else pavr=pavr-NLTA;
if( zpav < NLTA) pavs++;
else pavs=pavs-NLTA;
lrk[r]=lrk[r]-*pavr; /* subtract off oldest short-time avg */
lsk[r]=lsk[r]-*pavs; /* subtract off oldest short-time avg */
*pavr= drk[r];
```

-continued

```
*pavs= dsk[r];
mr[r]=(NLTA * * pavr) −lrk[r];
ms[r]=(NLTA * * pavs) −lsk[r];
}
ms[s]= ms[1];
for(r=2; r <= NLOOK; r++){
if(ms[r] > ms[r])ms[s]=ms[r]; /* search for largest value */
}
newsource = 0; /* set newsource to indicate no new source */
for(r=0; r < NLOOK; r++){
if(mr[r] > ms[s] && zrk[r] <= zthresh){
ms[s]= ms[r];
s=r; /* store new position */
newsource = 1;
}
if(newsource == 1){
pd2 = &delv[s][0]; /* new source at position s */
for(chadd=1; chadd <= NMICS; chadd++)IOB2 −> DSPC2 =
*pd2++;
}
if(zpav < NLTA) zpav ++;
elsezpav=0;
}while (1);
 }
}
/* include file ad_clk. */
/* control structure for andromeda adc */
/* control structure for andromeda adc12 board */
struct adc {
short acsr;
short abuf;
};
#define ADCREG register struct adc *ADC =
(struct adc *)0×ffff100;
/*abuf bits
0−3number of trancation channel
adcsr bits
13sequence enable
12burst enable
11−8channel number
7done
5clock start enable
1truncation enable
Ogo: real time clock controlled or must be set */
/* control structure for prtc11 programmable real time clock */
struct pclk 5
short pcsr;
short pcnt;
};
#define CLKREG register struct pclk *CLK =
(struct pclk *)0×fff110;
/* pcsr bits
7clock overflow
5−3rate select(001=1 Mhz,100=1 Khz)
2−1mode(01=repeated interval,00=single interval)
Ogo */
/* implies 0×b for 1us continuous ×21 for 1ms single */
/* include file struct.h */
/* i/o bus i/o */
struct iobus1 {
short DSPC1;
short IOCC1;
short IOP11;
short IOP21;
};
struct iobus2 {
short DSPC2;
short IOCC2;
short IOP12;
short IOP22;
};
#define IOBREG1 register struct iobus1 *IOB1 =
(struct iobus1 *)0×ffe000;
#define IOBREG2 register struct iobus2 *IOB2 =
(struct iobus2 *)0×fff000;
/* subroutine delay −calculate delay values for array */
#define nmics 380
delay (del,phi,theta)
int *del,phi,theta;
{
int delmin,del2min,ij,n;
static int mictab[]={d1,d2,d3, . . . , dn};
```

-continued

```
{
del2min=200;
delmin=200;
phi=phi − 3;
theta=theta − 3;
for(n = 0; n< nmics ; n++){
ij=2*n;
del[n]=((mictab[ij]+25)*theta)+((mictab[ij+1]+25)*phi);
if(del[n] <= delmin)delmin = del[n];
 }
for(n=0; n < nmics; n++){
del[n]= 113 + delmin −del[n];
if(del[n] <= del2min)del2min = del[n];
}
del2min = del2min/2;
if(del2min < 0){
for(n = 0; n < nmics ; n++){
del[n] = del[n] − del2min;
if(del[n] > 113)del[n] = 125;
if(del[n] < 0)del[n] = 125;
  }
 }
for(n = 0; n < nmics ; n++){
del[n] = del[n] + 128*n;
 }
}
return;
}
/* Subroutine adx − get A/D values from A/D converter */
#include "ad_clk.h"
adx (buf,wc,rate,startch,truncch) /* (array,# samples,rate,#
channels) */
register short *buf;
short rate,startch,truncch;
register long wc;
{
  register short buf1;
ADCREG
 CLKREG
 /* enable adc */
ADC−>acsr = 0;
while ((ADC−>acsr & 0×80)!= 0)*buf = ADC−>abuf;
ADC−>acsr = 0×2022 + 256*startch;  /* trunc mode: start
chan */
ADC−>abuf = truncch;
/* start clock */
CLK−>pcnt = −rate;
CLK−>pcsr = 0×B;
while (wc){
/* wait for convert complete */
while ((ADC−>acsr & 0×80) == 0);
buf1 = (ADC−>abuf)< <4;
if(buf1 > 16384) printf("\ n\ r!! input out of range?
%d (16384<  >32768)",buf1);
*(buf++) = buf1 >> 4;
wc−−;
}
/* turn off clock */
CLK−>pcsr = 0;
}
```

What is claimed is:

1. A signal processing arrangement of the type including means including a plurality of electroacoustical transducer means for forming a plurality of receiving beams at least one of which is steerable, means for steering the steerable receiving beam to intercept sound from at least one specified direction, and means for forming an output signal responsive to energy from said transducer means which energy is from one of said receiving beams, said arrangement being characterized in that the steering means is adapted to intercept sound from at least one specified direction different from that of another beam, and the plurality of transducer means respectively include means adapted to generate sound feature signals which can serve to distinguish speech from noise or reverberations from respective specified directions, and the output signal forming means includes means adapted to select one speech signal from one of the respective specified directions, the selection being based upon a comparison of the speech signals from the respective specified directions.

2. A signal processing arrangement according to claim 1 in which the sound feature signal generating means is further characterized in that it includes means for producing a signal representative of the short term energy of the sound from said location and a signal representative of the long term energy of the sound from said location, and means for combining said short term energy signal with said long term energy signal.

3. A signal processing arrangement according to claim 1 in which the sound feature signal generating means is further characterized in that it includes means for generating a signal representative of the periodicity of the sounds emanating from the specified location.

4. A signal processing arrangement according to claim 1 in which the sound feature signal generating means is further characterized in that it includes means for generating a signal representative of the slowly-varying formant structure of the speech sounds emanating from the specified location.

5. A signal processing arrangement according to claim 1 further characterized in that a plurality of the beam-forming means are independently steerable to different directions.

6. A signal processing arrangement according to claim 1 further characterized in that the steering means steers the steerable beam-forming means to scan sequentially the respective specified directions.

7. A signal processing arrangement according to claim 6 further characterized in that a second one of the beam-forming means is adapted to receive a reference speech signal, the forming means includes means adapted to select one speech signal from one of the respective specified directions, the selection being based upon a comparison of the output from the steerable transducer means and the reference speech signal from the second transducer means.

8. A method for processing signals from a plurality of directions in an environment, of the type including the steps of:

forming a plurality of sound receiving beams corresponding to a plurality of the directions, including forming at least one steerable sound receiving beam, steering the steerable beam to intercept sound from at least one specified direction, and forming an output signal responsive to an intercepted sound, said method being characterized in that the steering step is adapted to intercept sound from a specified direction different from another of the directions of the sound receiving beams, the beam-forming step includes generating sound feature signals which can serve to distinguish speech from noise or reverberation, and the output signal forming step includes selecting a speech signal from a specified direction based upon a comparison of the sound feature signals.

9. A method according to claim 8 further characterized in that the sound feature signal generating step includes producing a signal representative of the short term energy of the sound and a signal representative of the long term energy of the sound, and combining said representative signals.

10. A method according to claim 8 further characterized in that the sound feature signal generating step includes generating a signal representative of the periodicity of the sound.

11. A method according to claim 8 further characterized in that the sound feature signal generating step includes generating a signal representative of the slowly-varying formant structure of the sound.

12. A method according to claim 8 further characterized in that the beam-forming step includes forming a plurality of independently steerable sound receiving beams each intercepting sound from a respective specified direction different from that of another.

13. A method according to claim 8 further characterized in that the steering step includes scanning the beam to intercept sound sequentially from a plurality of directions.

14. A method according to claim 13 further characterized in that the beam-forming means includes forming a reference beam receiving a reference speech signal, and the output signal forming step includes selecting the output signal from a specified direction based on a comparison between the reference signal and the sequentially-intercepted signals.

* * * * *